US007543419B2

(12) United States Patent
Rue

(10) Patent No.: US 7,543,419 B2
(45) Date of Patent: Jun. 9, 2009

(54) INSULATED STRUCTURAL BUILDING TRUSS PANEL

(76) Inventor: Jerry Randall Rue, 3412 SE. Vineyard Rd., No. 2, Milwaukie, OR (US) 97267

( * ) Notice: Subject to any disclaimer, the term of this patent is extended or adjusted under 35 U.S.C. 154(b) by 673 days.

(21) Appl. No.: 11/068,609

(22) Filed: Feb. 28, 2005

(65) Prior Publication Data

US 2005/0204699 A1 Sep. 22, 2005

Related U.S. Application Data

(60) Provisional application No. 60/549,587, filed on Mar. 3, 2004, provisional application No. 60/555,985, filed on Mar. 24, 2004.

(51) Int. Cl.
*E04C 2/32* (2006.01)
*E04C 1/00* (2006.01)
*E04C 2/00* (2006.01)

(52) U.S. Cl. ..... 52/630; 52/309.7; 52/309.16; 52/782.1

(58) Field of Classification Search ..... 52/690–697, 52/633, 634, 639, 794.1, 309.7, 309.16, 630
See application file for complete search history.

(56) References Cited

U.S. PATENT DOCUMENTS 3,217,452 A * 11/1965 Steele ..... 52/242
3,857,218 A * 12/1974 Gilb ..... 52/694
3,985,459 A * 10/1976 Gilb ..... 403/217
4,069,635 A * 1/1978 Gilb ..... 52/693
4,077,176 A * 3/1978 Bauer ..... 52/693
4,089,148 A * 5/1978 Oehmsen et al. ..... 52/693
4,106,257 A * 8/1978 Gilb ..... 52/693
4,241,555 A 12/1980 Dickens et al. ..... 53/454
4,284,447 A 8/1981 Dickens et al. ..... 156/78
4,653,718 A 3/1987 Dickens ..... 249/95
4,736,610 A * 4/1988 Carroll et al. ..... 72/325
4,741,139 A * 5/1988 Campbell ..... 52/408
4,837,999 A * 6/1989 Stayner ..... 52/309.11
4,909,007 A 3/1990 Bodnar ..... 52/356
4,909,132 A * 3/1990 Kling et al. ..... 92/190
4,953,334 A 9/1990 Dickens ..... 52/309.4
5,689,922 A 11/1997 Daudet ..... 52/210
5,842,315 A * 12/1998 Lin ..... 52/309.9
5,893,248 A * 4/1999 Beliveau ..... 52/309.7
5,899,037 A * 5/1999 Josey ..... 52/267
6,085,485 A * 7/2000 Murdock ..... 52/783.19
6,122,888 A 9/2000 Bodnar ..... 52/745.05
6,263,628 B1 * 7/2001 Griffin ..... 52/309.12

(Continued)

OTHER PUBLICATIONS

"ThermaSteel Panels," 6 pp., c. 2004, ThermaSteel Corporation, Richmand Hill, Ontario, Canada (Brochure).

(Continued)

*Primary Examiner*—Richard E Chilcot, Jr.
*Assistant Examiner*—Andrew J Triggs
(74) *Attorney, Agent, or Firm*—Whitaker, Chalk, Swindle & Sawyer, LLP; Stephen S. Mosher

(57) ABSTRACT

An insulated structural truss panel, comprising: a rectangular panel body formed of a rigid foam material and a parallel arrangement of at least first and second trusses embedded longitudinally within the panel body at predetermined on-center spacings between and parallel to the first and second sides.

13 Claims, 16 Drawing Sheets

U.S. PATENT DOCUMENTS

| | | | | |
|---|---|---|---|---|
| 6,263,634 | B1 | 7/2001 | Bodnar et al. | 52/731.1 |
| 6,264,734 | B1 | 7/2001 | Dickens | 106/600 |
| 6,350,308 | B1 | 2/2002 | Dickens | 106/600 |
| 6,988,852 | B2 * | 1/2006 | Bussey et al. | 405/38 |
| 7,228,670 | B2 * | 6/2007 | Ollman | 52/633 |
| 7,237,360 | B2 * | 7/2007 | Moncho et al. | 52/28 |
| 2004/0134155 | A1 * | 7/2004 | Lockwood et al. | 52/633 |
| 2005/0055951 | A1 * | 3/2005 | Ollman | 52/633 |

OTHER PUBLICATIONS

"Intro to Metal Framing—A Basic Overview," 5 pp., Jan. 2005, Dietrich Industries, Pittsburgh, PA 15219, www.dietrich industries.com (White Paper).

"Building Panel Combines Foam Insulation and Steel Frame," 2 pp., from a copyrighted article in *Energy Soucre Builder #37*, Apr. 1995, Iris Communications, Inc. (see also www.oikos.com) (Article reprint).

"Preformed U-Shaped Header," 1 pp, Jan. 2005, Dietrich Industries, Pittsburgh, PA 15219, www.dietrichindustries.com (Data Sheet).

"Strurctural Insulated Panels," 10 pp., c. 2003, U.S. Dept. of Energy, Energy Efficient and Renewable Energy Information Center, www.eere.energy.gov/consumerinfo/factsheets (Fact Sheet).

* cited by examiner

INSULATED STRUCTURAL BUILDING TRUSS PANEL

CROSS REFERENCE

The present U.S. patent application claims priority from earlier filed U.S. Provisional Patent Applications Ser. No. 60/549,587 filed Mar. 3, 2004 and entitled "Improved Foam Insulated Building Panel And System," and Ser. No. 60/555,985 filed Mar. 24, 2004 and entitled "Foam Insulated Building Panel And Utility System."

BACKGROUND OF THE INVENTION

1. Field of the Invention

The present invention generally relates to insulated structural building panels and, more particularly, to advances in the design of the building panels enabling significantly reduced costs of manufacturing the panels and of constructing buildings using the panels.

2. Background of the Invention

Insulated building panels having both structural and insulating properties have long been available in several forms. Among the better known types are structural insulated panels ("SIP"), which typically comprise a solid core of insulating material, such as expanded polystyrene ("EPS"), sandwiched between and bonded to a relatively thin, rigid panel of wood or a laminated material, such as oriented strand board ("OSB") to provide the needed structural strength to support the various types of loads encountered in a finished building. Other types of insulated building panels rely on metal framing members to provide the needed structural properties. The combination of metal framing members and the EPS core provides improved durability, resistance to insects and the effects of moist environments, in addition to their insulating properties.

Conventional building panels fabricated of expanded polystyrene (EPS) foam and steel framing members ("foam/steel panels") can provide wall panels for one and two story buildings having excellent insulating properties. The steel framing members or "studs" that are incorporated in these conventional building panels provide structural strength and stability, as well as resistance to insect damage and the effects of moist climates. The combination of the steel framing members and the EPS foam in the conventional building panels provides a relatively light weight panel that is easily handled and erected at a building site. However, the conventional foam/steel building panels are characterized by several significant inefficiencies in the manufacture of the panels and the construction of buildings that results in relatively high costs as compared to ordinary wood frame "stick built" construction.

For example, in FIG. 1A, there is illustrated a cross section one example of a prior art insulated building panel 10 wherein the steel stud members 12 are secured in the foam body 14 of the building panel using a heat activated adhesive 16 applied to the stud members 12 prior to molding the panel. As shown in FIG. 1A, the heat activated adhesive 16, shown as the dashed lines, may be applied to the inside surface of the channel-shaped stud members 12 prior to molding the panel. The stud members 12, typically formed of 24 gauge, galvanized steel, are approximately the same dimensions as wood framing studs. During molding, the heat from the expanding polystyrene foam activates the adhesive 16, bonding the inside surface of the stud members 12 to the foam material 14. Applying the adhesive 16 is a distinct manufacturing step involving its own tooling, set-up and material costs. This prior art example is typically available in widths having standard sixteen inch or twenty-four inch on-center ("O.C.") spacing. In some examples, complex ship lap joints (not shown) are utilized along the panel edges to provide both a sturdy joint and a thermal break. Other panel sizes may be custom ordered, generally at higher costs to cover the tooling, set-up, and the like.

In FIG. 1B, there is illustrated a cross section of another example of a prior art insulated building panel 20 wherein the steel stud members 22 are secured in the foam body 24 of the building panel 20 using mechanical fasteners 26 between opposing pairs of stud members 22. In this configuration, the steel stud members 22 are a box section member, formed of 18 gauge steel and have dimensions of approximately 1"×2" in cross section. The studs 22, on 24 inch spacings, are assembled in grooves routed in the surface of the foam panel 24 on opposite sides of the panel 24. Each one of a pair of stud members 22 is secured to the opposite stud member 22 with a screw fastener 26 that passes through the foam material 24, connecting the stud members 22 together. As in the previous example, this prior art example requires a distinct manufacturing step involving additional tooling, set-up and material costs. Moreover, this design lacks a thermal break between each pair of metal studs.

Because of their construction, conventional foam/steel panels are typically available in limited standard sizes and configurations in order to minimize manufacturing costs. Inefficiencies further result from the methods employed to secure the steel framing members to the EPS foam body of the panels. Moreover, since most buildings are generally different from each other in many respects, the standard panels must be cut to size or shape to fit a particular application, which is a labor-intensive and expensive task if conventional tools are used. Alternatively, the panel parts may be prefabricated at the place of manufacture to submitted detail drawings, which is also time consuming and expensive, and generally involves costly tooling and set-up charges. The effect of all of these cost factors substantially limits the marketability of these highly thermal efficient building panels for all but uncomplicated, standardized structures.

What is needed is a foam/steel panel design and component system that enables substantial economies of manufacture and on-site assembly during the construction of buildings such that the use of the foam/steel insulated building panels is at least cost competitive with wood framing and other types of building construction.

SUMMARY OF THE INVENTION

Accordingly, there is disclosed a foam insulated structural truss panel for use in floor and ceiling applications requiring high load-carrying capacity, comprising: a rectangular panel body formed of a rigid foam material and having a defined width between first and second sides, first and second ends separated by a defined length, and first and second substantially parallel faces; and a parallel arrangement of at least first and second floor trusses, each truss having upper and lower chords, a truss web disposed between each upper and lower chord and a length substantially equal to the defined length of the panel body, in which the floor trusses are embedded longitudinally within the panel body at predetermined on-center spacings between and parallel to the first and second sides.

In another aspect, each of the plurality of truss members comprises a truss formed of first and second parallel truss chords having a truss web disposed therebetween. Each truss chord is diagonally interconnected to the other truss chord via the truss web at insulated pins alternately spaced at predetermined equal intervals along the first and second truss chords. The truss web is formed of a continuous sequence of diagonal struts alternatingly coupled to the insulated pins at each apex of the truss web.

In another aspect of the invention, each first and second truss chord of the truss is roll-formed from sheet metal into a generally T-shaped cross section wherein a cross bar portion of the T forms the outer side of the truss chord and a web portion of the T supports the insulated pins therethrough and extends inward toward the opposite truss chord when in position in the truss. Further, the truss web is formed of a single continuous metal strip looping around and secured to the insulated pins alternately between the first and second truss chords of the truss from the first end of the truss to the second, opposite end of the floor truss. The insulated pins may be formed of metal rod material surrounded by a sleeve of an insulating material for providing a thermal break.

In some embodiments, utility ducts or chases may be formed in the insulated structural truss panels. The insulated structural truss panels may have semicircular grooves formed along edges thereof and acting as mortises to permit use of a column of foam material to fill the voids and form a tenon when joining two truss panels together, edge-to-edge.

In yet another aspect of the invention, the trusses are formed and assembled in a continuous process which roll forms the truss chords and the truss web, respectively feeding them into position in a fixture for alternately connecting the truss web successively to each insulated pin inserted into the web portion of the truss chord and securing the truss web to the respective insulated pins in turn. The truss assembly is fed, in predetermined lengths, into a cavity of a molding machine to be embedded in the molded panel body, thus forming the insulated structural truss panel.

DETAILED DESCRIPTION OF THE INVENTION

Figure 1A:
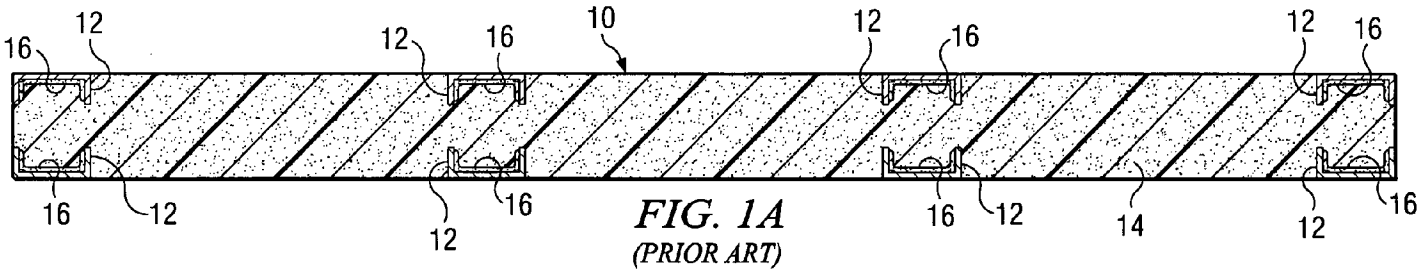
FIG. 1A (PRIOR ART)
FIG. 1A illustrates a cross section one example of a prior art insulated building panel wherein the steel stud members are secured in the foam body of the building panel using a heat activated adhesive applied to the stud members prior to molding the panel.
Figure 1B:
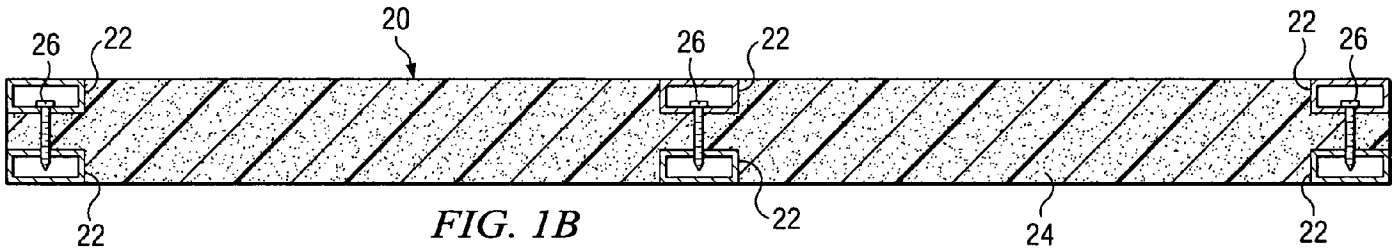
FIG. 1B (PRIOR ART)
FIG. 1B illustrates a cross section of another example of a prior art insulated building panel wherein the steel stud members are secured in the foam body of the building panel using mechanical fasteners between opposing pairs of stud members prior to molding the panel.
Figure 2A:
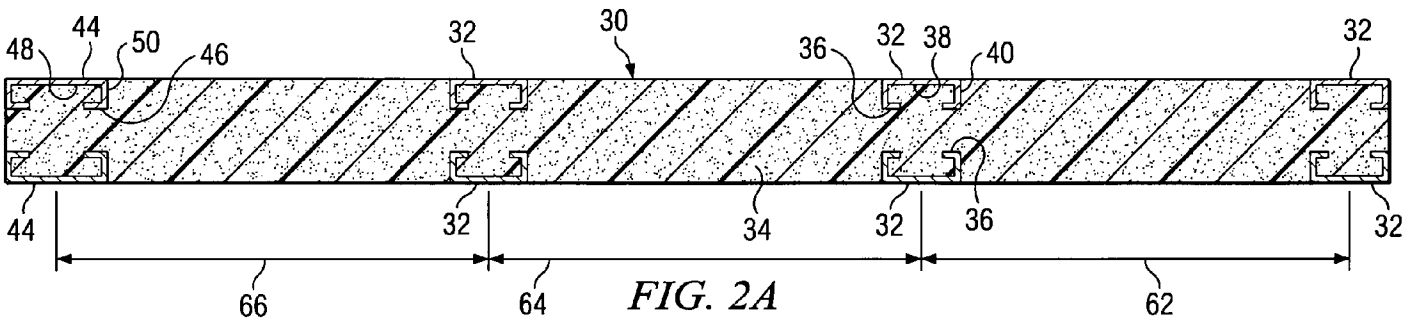
FIG. 2A illustrates a cross section of one embodiment, in simplified form, of an improved insulated building panel according to the present disclosure having steel framing members that have a return lip disposed along each edge of the steel framing member to retain the framing member in the foam body of the insulated building panel without adhesives or other fasteners, wherein the framing members may be disposed at standard sixteen inch on-center spacing.

Referring to FIG. 2A, there is illustrated a simplified cross section through the width of one embodiment of an improved insulated building panel, i.e., an insulated structural building ("ISB") panel 30 according to the present disclosure. The ISB panel 30 shown in FIG. 2A has a panel body 34 that is illustratively approximately 4.00 inches thick and 48 inches wide. The ISB panel 30 further has embedded framing members 32, 44 that have an inward-directed "return" lip 36, 46 respectively disposed along each edge of each of the channel-shaped framing members 32, 44. The purpose of the return lip 36, 46 (identified on only one of each type of framing member 32, 44) is to retain the framing member 32, 44 in the rigid foam panel body 34 of the ISB panel 30 without adhesives or mechanical or other fasteners. It will be appreciated that the return lips 36, 46 are preferably directed inward toward each other in ISB panels having framing members disposed along the edges of the panel body. However, in ISB panels in which the framing members are not disposed at the edges of the panel body, the return lips could as easily be directed outward or away from each other and fulfill the same purpose of retaining the framing members within the rigid foam without the use of adhesives or mechanical or other fasteners. At the left edge of the ISB panel 30 the framing members 44 are shown having a greater width for use in corner junctions of ISB panels 30, as will be described herein below.

The framing members 32, 44, which may be formed of rigid sheet material, such as metal, plastic, composites, or other synthetic or manufactured material, are preferably fabricated of 20 gauge, galvanized sheet steel in typical applications. Other metal gauges are feasible, depending on the expected loading to be supported or withstood by the ISB panels. The framing members generally have a similar, channel-shaped configuration in cross section, and will normally be directly opposite each other on opposite faces of the panel body, with the open sides of the framing members facing each other. Further, in the illustrative embodiment, the framing members are oriented parallel the edges of the panel body and to each other on each face of the panel body. However, in other embodiments the framing members may be staggered on opposite sides of the panel body or oriented in non-parallel directions on the face of the panel body. In still other embodiments, the framing members may be fully embedded in the rigid foam material of the panel body.

Continuing with FIG. 2A, the framing member 32 includes a web 38, a leg 40 along each side of the web 38, and a return lip 36 along the free edge of each leg 40. Similarly, the framing member 44 includes a web 48, a leg 50 along each side of the web 48, and a return lip 46 along the free edge of each leg 40. One typical dimension for the web 38 may be 3.500 inches. A typical width of the web 48 may be 5.500 inches. Other widths may, of course, be used. The leg portions of the framing member, as shown in the figure, may be 1.500 inches or, alternatively, other dimensions. The dimensions of 3.500 inches wide by 1.5 inches thick correspond with the standard dimensions of so-called "2×4" dimension limber, as is well known. The dimension of the return lip may typically be approximately 0.500 inch; but again, other dimensions may be suitable. Moreover, the return lips may be directed inward toward each other or, when the framing member is located away from an edge of the panel body, the return lips may be directed outward and away from each other. The framing members 32, 44 of FIG. 2A are shown disposed at uniform on-center spacings 62, 64, and 66, although other spacings may be used. The spacings shown approximate the standard 16 inch O.C. spacings typically used in many types of buildings.

Continuing with FIG. 2A, the illustrated panel 30 is 48 inches wide but may readily be manufactured in other widths, being limited only by the capacity of the molding machine used to fabricate the ISB panels 30. In one example, a conventional block molding machine of the type used for molding large blocks of expandable foam may be used, with a mold cavity adapted to receive the framing members in position prior to introducing the ESP beads into the mold cavity, followed by releasing steam into the cavity to heat the ESP beads and cause their expansion into all parts of the mold cavity. The shape of the framing member 32, 44 shown in FIG. 2A, including the return lip 36 along each edge of each leg 40 of each framing member 32, 44, is uncomplicated enough to be economically roll-formed in a continuous process, which may feed the formed framing member stock into the cavity of the molding machine, for example. In such a process, the framing members (each approximately eight feet long, for example) may be fed into the mold cavity in their respective locations to be embedded into the foam material of the panel body 34 as the expanded polystyrene ("ESP") material is introduced into the mold. As the ESP material expands and solidifies, it surrounds the framing members 32, 44, securing them in their permanent positions within the rigid foam of the panel body 34. Because this embodiment eliminates the extra manufacturing steps of securing the framing member 32, 44 to the foam material of the panel body 34, fabricating economies are realized and a variety of spacings of the framing members 32, 44 is readily provided, as indicated by one example shown in FIG. 2B to be described.

Figure 2B:
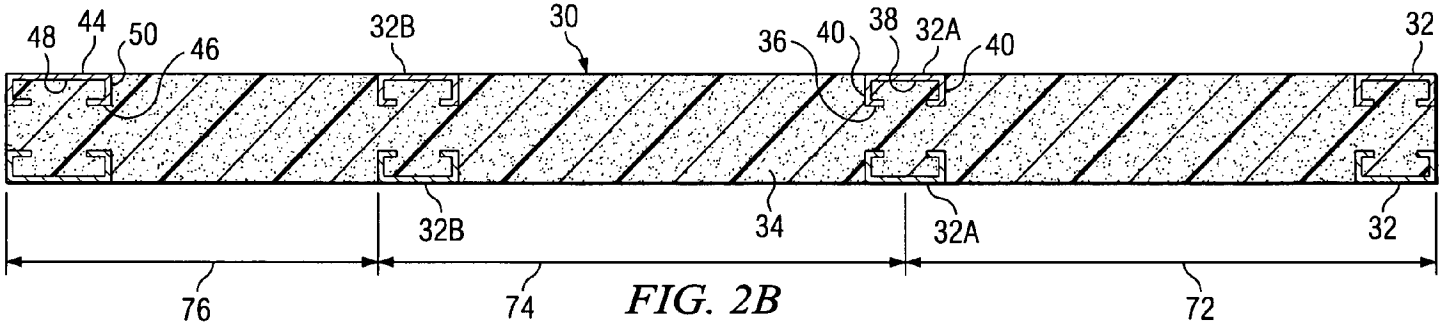
FIG. 2B illustrates an alternate embodiment, in simplified form, of the improved insulated building panel according to FIG. 2 of the present disclosure wherein further the panel includes an alternate spacing of the framing members to facilitate their use as in-fill panels at the location of door and window openings along a wall.

FIG. 2B is similar to FIG. 2A, and bears the same reference numbers for identical structures, except that the two intermediate framing members 32A and 32B, and their respective counterparts on the opposite face of the ISB panel 30, are spaced differently relative to the right-hand edge of the ISB panel 30 in the figure. In the figure the spacings 72 and 74 are substantially equal, together providing a predetermined combined width of, for example, 36 inches. The remaining width of the segment of the ISB panel 30, the dimension indicated by the reference number 76, is thus 12 inches. The purpose of providing this particular predetermined spacing of the framing members is to enable providing a 36 inch wide ISB panel for use as in-fill panels above and below window openings (or above door openings) of the same width. The in-fill panels may thus be cut to the desired width on the building site. No special ISB panel need be provided, because the in-fill panel is provided—i.e., cut from—from a multi-use ISB panel 30. The 12 inch remainder segment of the ISB panel 30 may then be used as a filler between a doorway and nearby corner, for example. Other predetermined spacings between the framing members may be utilized and the ISB panels easily fabricated using a continuous index molding process, as will be described.

An additional feature of the foam/steel ISB panels of FIGS. 2A and 2B is that the framing members 44 embedded at one edge of the panel (the left-hand edge in the figures) may be wider to facilitate securing the ISB panels to each other in corners and to facilitate the attachment of drywall on inside corners. As will be described further herein below, the wider framing member provides for a portion of the framing member 44, on the inside of the corner joint, to extend beyond—i.e., become exposed beyond the thickness of an adjoining ISB panel—enabling a drywall nail or screw to be inserted through the edge of the drywall and into the exposed edge of the framing member 44. The larger framing member 44 also is stronger, enabling it to carry greater vertical loads from smaller openings (up to four feet wide) without additional support.

Figure 3A:
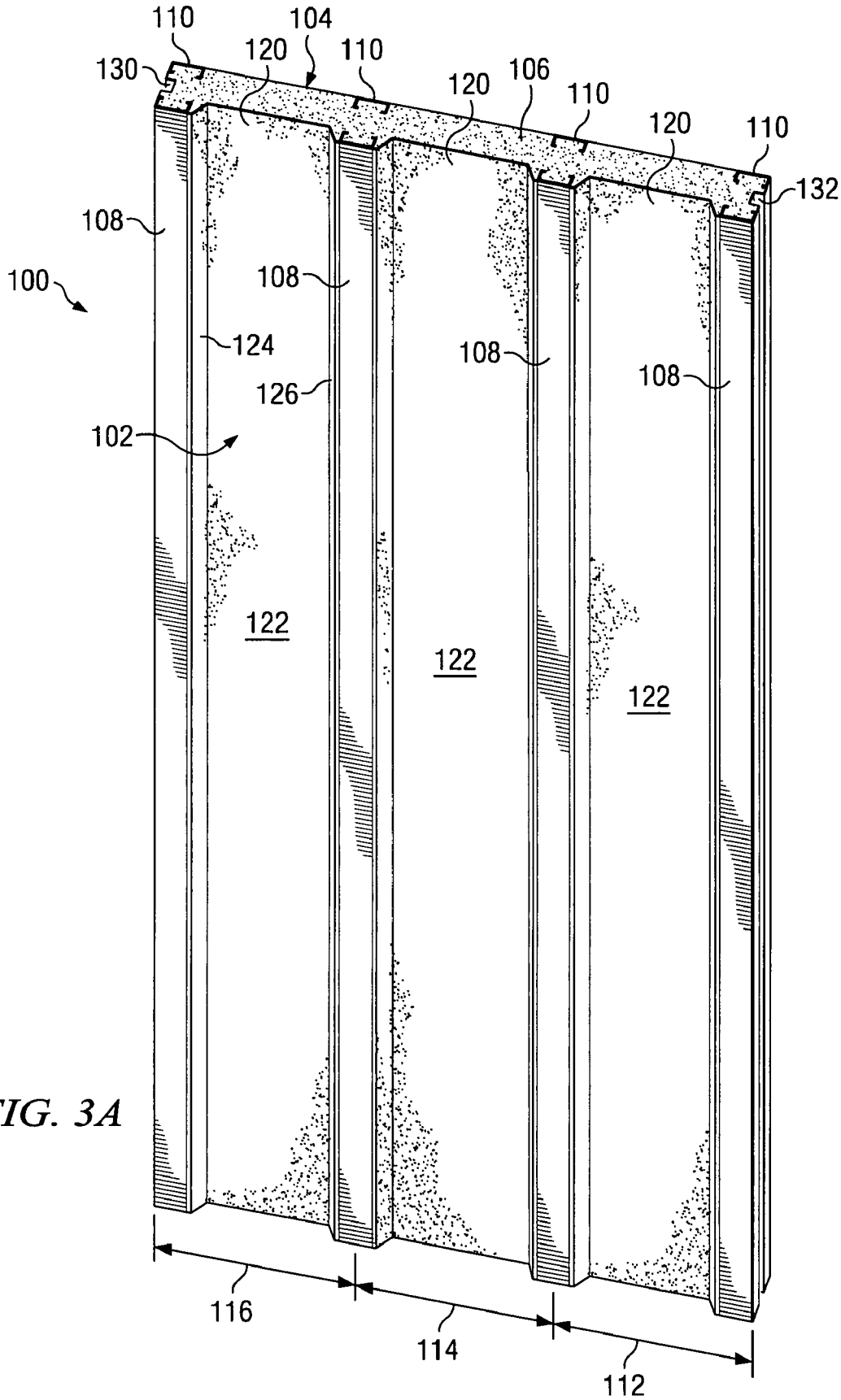
FIG. 3A illustrates one embodiment of an insulated structural building panel according to the present disclosure.
Figure 3B:
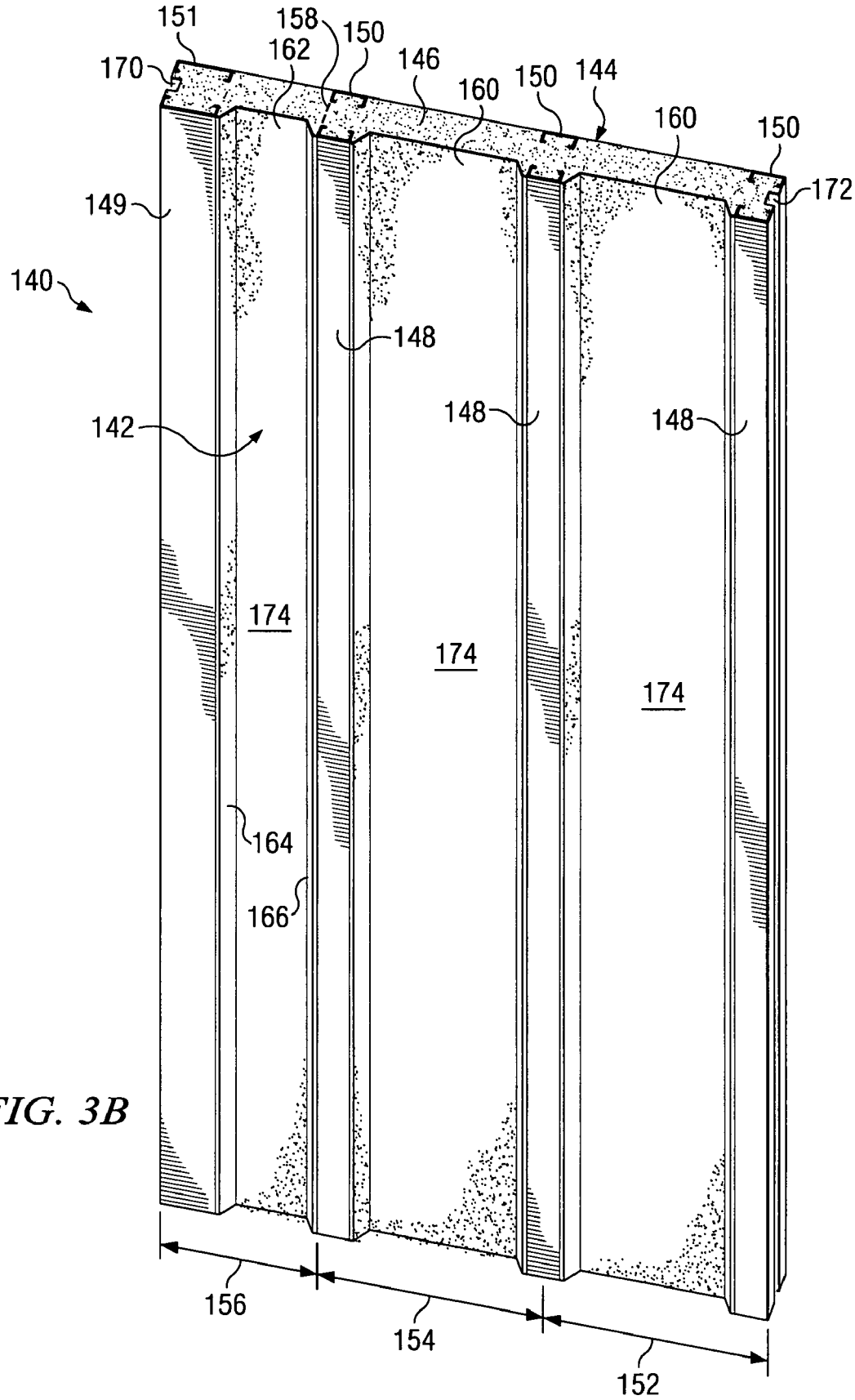
FIG. 3B illustrates a second embodiment of an insulated structural building panel according to the present disclosure.
Figure 3C:
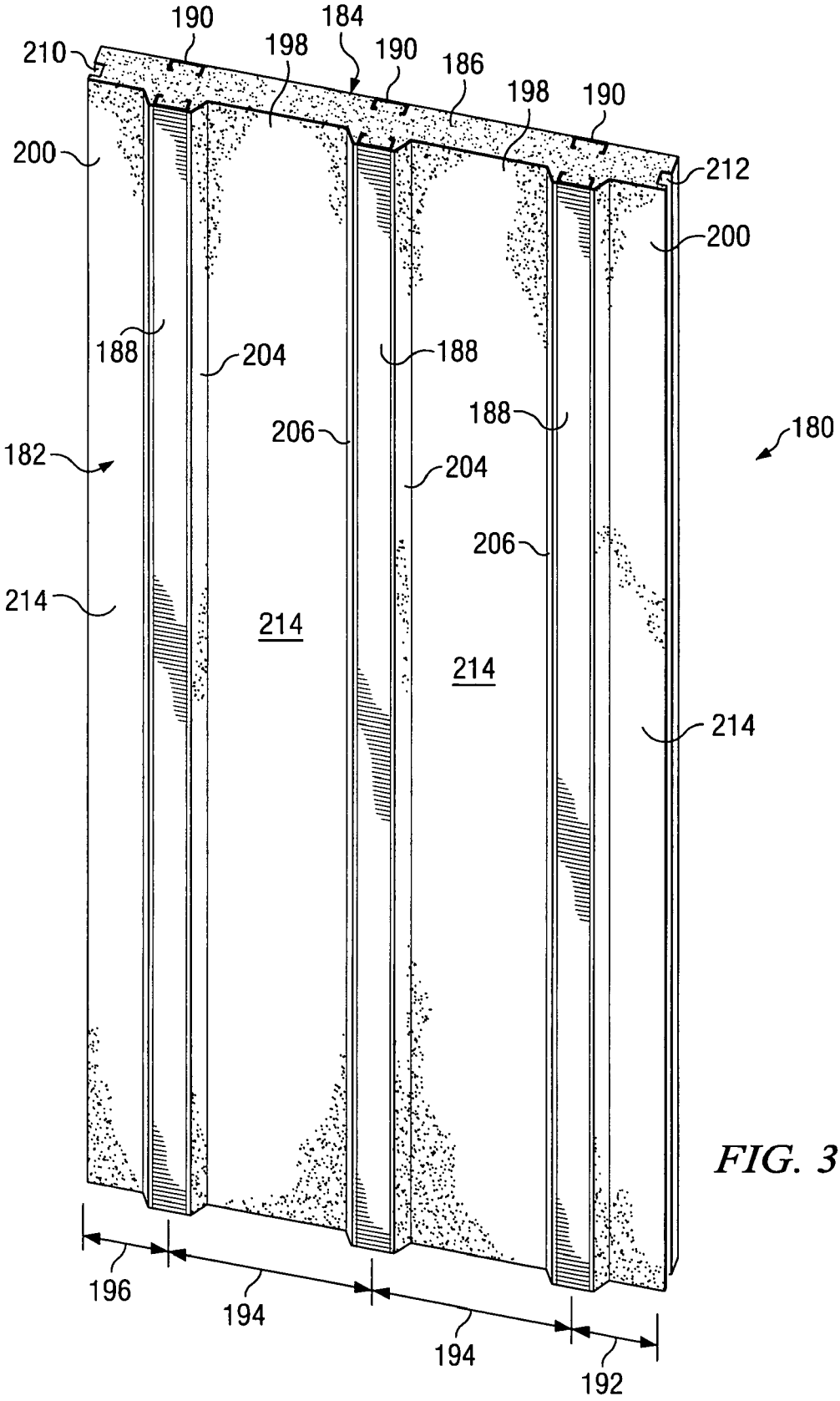
FIG. 3C illustrates one embodiment of an insulated non-structural building panel according to the present disclosure.

Referring to FIGS. 3A, 3B, and 3C, there are illustrated several alternative embodiments of the ISB panels according to the present disclosure. Three exemplary embodiments, which may typically be approximately 48 inches wide, 95.50 inches long, and 4.00 inches thick, are designated respectively as a "standard" ISB panel, a "DWC" ISB panel, and a "non-structural" ISB panel. Other panel sizes are possible; the ones given herein being illustrative. The framing members of each of the ISB panels are formed with return lips to retain the framing members embedded in the rigid foam of the molded panels without the use of adhesives or other fasteners. The three alternative embodiment panels illustrated in FIGS. 3A, 3B, and 3C all include longitudinal ducts or troughs between and parallel to the metal framing members to provide for utility traces or conduits. These ducts or troughs are formed to a depth, relative to a first face that includes the framing members, that is less than one-half the thickness of the panel—typically a depth of approximately 1.500 inches. For example, a standard four-inch thick panel may have a thickness of five-and-one-half inches in the vicinity of the metal framing members while remaining at the standard four-inch thickness between the metal framing members. Each of the ISB panels may further include mortises formed into each of the edges along the longest dimension. Keys formed of rigid foam and inserted in adjacent mortises between two ISB panels joined together maintain alignment of the ISB panels and provide a stronger, insulated joint without the use of other fasteners. The ISB panels disclosed herein are distinguished from the prior art by the combination of features listed in the foregoing. The three exemplary ISB panels are configured for use in different applications in the construction of a building and are readily adaptable to being cut to size or assembled edgewise to satisfy virtually all of the wall and ceiling needs of a wide variety of buildings.

Referring to FIG. 3A, there is illustrated one embodiment of an insulated structural building ("ISB") panel according to the present disclosure. The ISB panel shown, designated as a "standard" ISB panel 100, includes metal framing members that have an inward-directed return lip disposed along each edge of the metal framing member to retain the framing member in the rigid foam panel body of the ISB panel without adhesives or other fasteners. Four such framing members are located on each face of the panel, each one nominally 3.500 inches wide, and are spaced at approximately equal intervals, to approximate a stick built wall segment having wooden studs nominally on 16 inch centers.

The standard ISB panel 100 of FIG. 3A includes a panel body 106 having a first face 102 and a second face 104. The panel body 106 may be formed of a rigid foam material that may be fabricated from expanded polystyrene ("ESP") foam in a conventional injection molding process. Embedded in the first face 102 of the panel body 106 are four framing members 108, one on each left and right edge and two disposed between them at approximately equal intervals. Embedded in the second face 104 of the panel body 106, directly opposite the respective framing members of the first face, are four additional framing members 110. The framing members, 108, 110, which are typically 3.50 inches wide and embedded in both the first 102 and second 104 faces, may be fabricated of galvanized sheet steel by a roll forming or equivalent process. Alternatively, the framing members 110 may be formed of plastic or other synthetic materials that may become available, such as fiber reinforced plastics or composites. The framing members 108, 110 are generally configured as a channel having the aforedescribed return lips, wherein the open side of the channel of each framing member 108, 110 faces toward the open side of the counterpart framing member on the opposite face of the ISB panel. In most applications, 20 gauge sheet material may be used, while other gauges may be used depending on the particular requirements of a design. In the exemplary embodiment shown, the framing members are fabricated of 20 gauge galvanized steel. Further, in the ISB panel 100 shown, the spacing interval 114 between the center lines of the intermediate framing members 108, 110 in a 48 inch standard ISB panel 100 is approximately 16 inches. The spacing intervals 112, 116 between an intermediate framing member center line and the edge of the ISB panel 100 is also approximately 16 inches.

Another feature of the ISB panel 100 of FIG. 3A is the disposition of the longitudinal utility ducts or wire troughs 120 in the spaces between the framing members 108 on the first face 102 of the ISB panel body 106. The purpose of the ducts or troughs 120 having sides 124, 126 is to provide utility traces for wiring conduits and plumbing lines. When wall board (not shown) is installed against the first face of the ISB panel 100, an enclosed space is formed between the wall board and the ducts 120 to contain and conceal the wiring and plumbing lines. The ducts 120 may be formed during the molding process. If it is necessary to run the wiring or plumbing laterally across the ISB panel 100, e.g., between adjacent ducts 120, a hole may be cut behind the framing member 108 between the ducts 120 to run the wiring or plumbing line to the next duct or trough. The hole may be easily cut in the ESP material using a hot knife, as is well known in the building trades. The thickness of the panel body 106 in the region of the ducts 120 is nominally 4.00 inches. The framing members 108 are effectively disposed on portions of the first face 102 of the panel body 106 that are elevated approximately 1.50 inches with respect to the bottoms 122 of the ducts 120. Both the elevated portions and the ducts 120 may have a cross section shape that is trapezoidal, as shown in FIG. 3A.

A further feature of the ISB panel 100 illustrated in FIG. 3A is a pair of mortises 130, 132 formed along a centerline in each edge of the panel body 106. The mortises 130, 132 may be used to secure the edges of adjoining ISB panels together using a strip of rigid foam material shaped to provide a key or a tenon (not shown in FIG. 3A, but see, e.g., FIG. 5, to be described) and inserted into the mortise 130 of one panel body 106 and the corresponding mortise 132 of an adjoining panel body 106 (not shown). The rigid foam material used to fabricate the key may be expanded polystyrene having a density of at least approximately 1.5 pounds per cubic foot.

Referring to FIG. 3B, there is illustrated a second, modified embodiment of an insulated structural building panel according to the present disclosure. This embodiment may be used as a standard ISB panel and is also configured to be cut into sections for use as in-fill panels in door and window openings. The ISB panel shown, which is designated as a "DWC" ISB panel 140, for "door, window, corner," also includes four framing members 148, 149 on the first face 142 and four framing members 150, 151 on the second face 144 of the panel body 146. The framing members 148, 150 are generally configured as a channel, wherein the open side of the channel of each framing member faces toward the open side of the counterpart framing member on the opposite face of the ISB panel. In most applications, 20 gauge material may be used, while other gauges may be used depending on the particular requirements of a design. As in the "standard" ISB panel, 20 gauge galvanized steel is used in the exemplary embodiment. The panel body 146 is molded of the same rigid foam material used to fabricate the standard ISB panel 100. Each of the framing members 148, 149 and 150, 151 have an inward-directed return lip disposed along the edge of each leg of the steel framing member to retain the framing member in the rigid foam panel body 146 of the DWC ISB panel 140 without adhesives or other fasteners.

Three of the framing members 148 on the first face 142 of the panel body 146 are disposed at on-center spacings to permit on-site cutting of a DWC ISB panel 140 to a 36" width along a cut line 158. When the panel body 146 is cut lengthwise at the position of the cut line 158 to this 36 inch width, a framing member 148 is disposed along each edge and one centered between them. This feature provides for easily fabricating upper and lower in-fill panel segments for the 85% of the window and door openings in most buildings that are 36 inches wide. Further, the DWC ISB panel 140 may be configured with other spacings of the framing members 148, 149 to enable on-site cutting of the standard widths to provide wall panel sections of 12 inch, 16 inch, 18 inch, 24 inch, 32 inch, and 36 inch widths from the standard panels, 48 inches wide, wherein both longer edges of the cut segment may be bordered by a framing member.

Another feature of the DWC ISB panel 140 shown in FIG. 3B, which may be included in any of the ISB panels, is the use of a wider than standard framing member 149 along one edge of the panel body 140. Normally, the wider framing member 149 will be located along the panel edge that is most likely to be positioned at a corner of a wall system, which may (arbitrarily) be the left-most edge as shown in the drawing. The wider framing member extends past the thickness of the adjoining ISB panel at the corner, as will be further described in conjunction with FIG. 4A herein below. The extended portion of the framing member is thus exposed and provides a nailing strip for the installation of wall board.

The DWC ISB panel 140 of FIG. 3B, just as in the standard ISB panel 100 of FIG. 3A, includes the longitudinal ducts 160 for wiring conduits or plumbing lines. Formed similarly as in the standard ISB panel of FIG. 3A, two of the ducts 160 are disposed on the first face 142 between the framing members 148 of the 36 inch wide "in-fill" segment of the panel body 146. A third duct 162 having sides 164, 166 is disposed between the framing member 148 next to the cut line 158 and the framing member 149 along the left-most edge of the panel body 146. The thickness of the panel body 146 in the region of the ducts 160, 162 is nominally 4.00 inches. The framing members 148, 150 are effectively disposed on portions of the first face 142 of the panel body 146 that are elevated approximately 1.50 inches with respect to the bottoms 174 of the ducts 160. Both the elevated portions and the ducts 160 may have a cross section shape that is trapezoidal, as shown in FIG. 3B. The DWC ISB panel 140 of FIG. 3B also includes the first mortise 170 and a second mortise 172 formed into the respective first and second edges of the panel body 146. The mortises 170, 172 may be used to secure the edges of adjoining ISB panels together using a strip of rigid foam material shaped to provide a key or a tenon (not shown in FIG. 3B, but see, e.g., FIG. 5, to be described) and inserted into the mortise 170 of one panel body 146 and the corresponding mortise 172 of an adjoining panel body 106 (not shown). The rigid foam material used to fabricate the key may be expanded polystyrene having a density of at least approximately 1.5 pounds per cubic foot.

Referring to FIG. 3C, there is illustrated one embodiment of an insulated non-structural building panel 180 according to the present disclosure. While it is a non-structural variation of the ISB panel system disclosed herein, it includes the same combination of features as the load-bearing ISB panels, differing only in the number and locations of the framing members. The ISB panel 180 illustrated in FIG. 3C is called a non-structural panel because it has no framing members along the edges (left and right in the figure) of the panel body 186. The framing members are provided along the edges of the ISB panels 100, 140 shown in FIGS. 3A and 3B to enable their use as load-bearing wall panels. The non-structural ISB panel 180 is typically used for interior wall construction where a load-bearing wall unit is not required.

Continuing with FIG. 3C, the panel body 186 of the non-structural ISB panel 180 includes a first face 182 and a second face 184. As in the exemplary ISB panels illustrated and described in FIGS. 3A and 3B, the first 182 and second 184 faces of the panel body 186 are parallel to each other and have framing members 188 and 190 embedded in the rigid foam panel body 186 such that the open sides of the framing members 188 and 190 face each other in pairs across the thickness of the panel body 186. In most applications, 24 gauge metal may be used for the framing members, while other gauges or rigid sheet materials may be used depending on the particular requirements of a design. The panel body 186 is molded of the same rigid foam material used to fabricate the standard ISB panel 100 and the DWC ISB panel 140. Each of the framing members 188 and 190 have an inward-directed return lip disposed along the edge of each leg of the respective framing member to retain the framing member in the rigid foam panel body 186 of the non-structural ISB panel 180 without adhesives or other fasteners. The framing members 188 disposed on the first face 182 and the framing members 190 disposed on the second face 184, of the panel body 186, are spaced at approximately equal intervals 194 as shown on the View in FIG. 3C. In the illustrated embodiment, the on center spacing may conveniently be approximately 16 inches. The back side of the panel body 186 is not shown in the figure but employs the same spacings 194 between the framing members 190. For on center spacing intervals 194 of 16 inches, the nominal spacing or width of the portions 192 of the panel body 186, to the left and right of the portion of the panel body 186 having the framing members 188, 190, is approximately eight (8) inches for a 48 inch wide ISB panel.

The non-structural ISB panel 180 of FIG. 3C, just as in the ISB panel 100 of FIG. 3A and the ISB panel 140 of FIG. 3B, includes longitudinal ducts 198 having sides 204, 206 for wiring conduits or plumbing lines. Formed similarly as in the ISB panel of FIG. 3A, two of the ducts 198 are disposed on the first face 182 between the framing members 188 of the panel body 186. As will be noted in the FIG. 3C, the ducts 198 along the edges of the panel body 186 are more accurately designated as duct segments 200. The thickness of the panel body 186 in the region of the ducts 198 and duct segments 200 is nominally 4.00 inches. The framing members 188 are effectively disposed on portions of the first face 182 of the panel body 186 that are elevated approximately 1.50 inches with respect to the bottoms 214 of the ducts 198 and the duct segments 200. Both the elevated portions and the ducts 198 may have a cross section shape that is trapezoidal, as shown in FIG. 3C. It will be further observed by persons in the art that the longitudinal ducts permit additional framing members (not shown) to be installed in the space provided in particular instances where additional load capacity is needed. Such framing members, attached to the top and bottom tracks (not shown) of a wall system, may be reinforced by blocking or bracing structures (not shown) to resist bending under load at one or more locations along the longitudinal duct containing the additional framing member.

The non-structural ISB panel 180 of FIG. 3C also includes the first mortise 210 and a second mortise 212 formed into the respective first and second edges of the panel body 186. The mortises 210, 212 may be used to secure the edges of adjoining ISB panels together using a strip of rigid foam material shaped to provide a key or a tenon (not shown in FIG. 3C, but see, e.g., FIG. 5, to be described) and inserted into the mortise 210 of one panel body 186 and the corresponding mortise of an adjoining panel body (not shown). The rigid foam material used to fabricate the key may be expanded polystyrene having a density somewhat greater than the adjoining ISB panels, preferably approximately 1.5 pounds per cubic foot.

The ISB panels described in FIGS. 3A, 3B, and 3C are configured for cutting to size on-site, just as one would cut a 4'×8' sheet of plywood, for example, without diminishing the utility and strength of the wall structures provided thereby. This configuration eliminates the need for made-to-order prefabrication of ISB panel components by the factory to predetermined specifications, and greatly reduces the number of different ISB panel sections required to build a variety of structures. Moreover, on-site construction is greatly facilitated by the use of a reciprocating table saw, which is the subject of a pending U.S. patent application Ser. No. 10/782,307 entitled "Reciprocating Table Saw" filed Feb. 19, 2004 by the applicant of the present application and incorporated herein by reference. For example, when finishing out a rough opening for a door or a window that is 36 inches wide, the in-fill panel and in-fill cap may be cut from 36 inch sections of a standard 48 inch ISB panel of the present disclosure as illustrated in FIG. 3B herein above, using the reciprocating table saw referenced above. This table saw utilizes a saw blade that is adapted to cutting both the steel framing members and the EPS foam material of the ISB panel. Set up of the saw is as simple as setting up a conventional table saw at a building site.

Figure 4A:
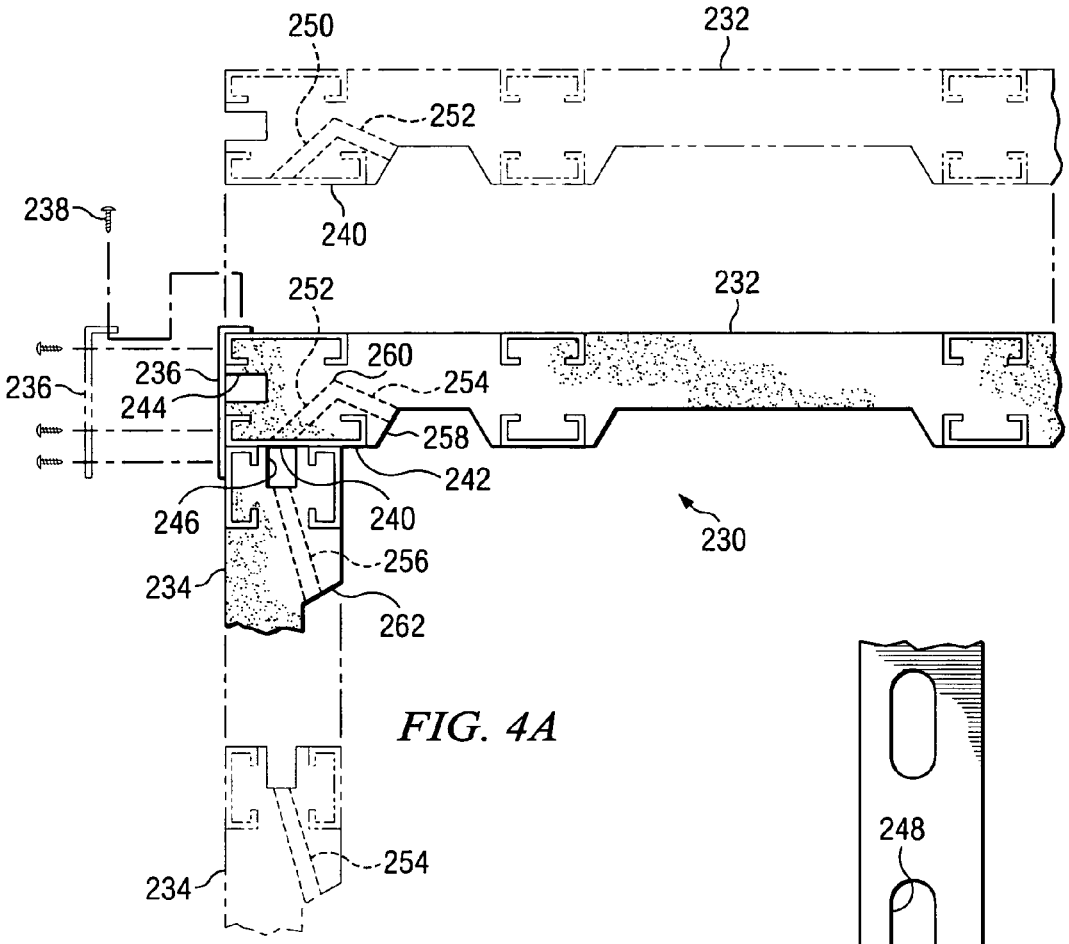
FIG. 4A illustrates a corner assembly detail of one combination of insulated structural building panels according to the present disclosure.

Referring to FIG. 4A, there is illustrated a corner assembly detail, shown in cross section, of one combination of insulated structural building panels according to the present disclosure. An assembled corner 230 is shown along with separate drawings of the first 232 and second 234 ISB panels, a corner bracket 236 for securing the ISB panels 232, 234 together and screws 238 for securing the corner bracket 236 to the ISB panels 232, 234. The dashed line arrows illustrate how the first ISB panel 232 is joined to a second ISB panel 234 and assembled to form the corner assembly 230. The corner bracket 236 is shown positioned against an end of the first ISB panel 232 and an adjoining end of the second ISB panel 234. The corner bracket 236 may preferably run along the entire length of the joint between the first 232 and second 234 ISB panels. The corner bracket 236 may be secured to the metal surfaces of the framing members of the first 232 and second 234 ISB panels in contact with the corner bracket 236 by using any one of several types of sheet metal screws 238. One preferred example of the screws 238 is a #8×½ inch "Tech" screw. The screws 238 may be inserted through holes (not shown) provided in the corner bracket 236 and, alternatively, in the metal framing members of the ISB panels.

Figure 4B:
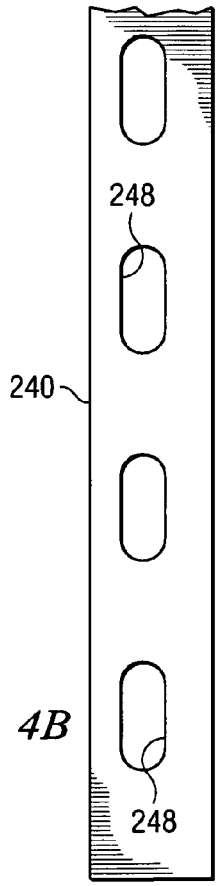
FIG. 4B illustrates a plan view of an alternative embodiment of a framing member for use along one inside edge of the panel embodiments of FIGS. 3A and 3B.

The assembled corner 230 of FIG. 4A includes a first ISB panel 232 having a framing member 240 along the side of the first ISB panel 232 that is placed against the edge of the second ISB panel 234. The framing member 240, also shown in FIG. 4B, is configured to be wider by a predetermined amount to provide approximately 1.50 inches of extension past the inside surface of the second ISB panel 234 at the inside of the corner assembly 230. This extension 242 of the wide framing member 240 exposes enough of the framing member 240 to allow for nailing the edge of a panel of wall board (not shown) into the exposed framing member 240 in the corner.

Also shown in FIG. 4A are mortises 244, 246 respectively in the ends of the ISB panels 232, 234. These mortises 244, 246, which run longitudinally along a center line of the edge of the ISB panel are the same as previously described for the ISB panels illustrated in FIGS. 3A, 3B, and 3C. The mortises 244, 246 may also be used as a convenient reference for drilling or cutting wire trace passages through the rigid foam material and around and through the framing members of the corner structure illustrated in FIG. 4A. One example of such wire trace passages shown in dashed lines are the positions of first passage 252 from a hole 248 provided in the framing member 240 and into the ISB panel 232 to a point 260 within the ISB panel 232, a second passage 254 from a utility duct 258 into the ISB panel 232 to the same internal point 260 in the ISB panel, and a third passage 256 from a utility duct 262 of the second ISB panel 234 to the mortise 246 formed in the edge of the second ISB panel 234. In the event time will elapse between the assembly of the ISB panels 232, 234 and the installation of wiring, a length of rope may be fed through the wire trace passages during assembly of the panels to facilitate pulling the wiring through the passage.

A second example of preparing a wire trace passage, which may be formed after the ISB panels have been assembled at the corner joint, is to drill or cut two passages from the mortise 244. One passage is directed through the first ISB panel 232 toward the utility duct 258, just past the edge of the framing member 240. The second passage may then be drilled or cut from the mortise 244 toward one of the holes 248 in the framing member 240, and through the mortise 246 toward the utility duct 262 of the second ISB panel 234. These passages are illustrative of passages that may be provided in the ISB panels to allow feeding electrical wiring around the corner assembly 230, from one ISB panel—e.g., the first panel 232—to the second panel 234 around the corner. Other passage configurations are possible; the one chosen will generally be the easiest to provide on site. The passages may be formed on site before or during the installation of the electrical wiring.

Referring to FIG. 4B, there is illustrated a plan view of the framing member 240 for use along one inside edge of the panel embodiments of FIGS. 3A and 3B. The framing member 240 is approximately 1.5 inches wider than framing members in other embodiments of the ISB panels to provide an exposed nailing edge when installed in a corner assembly such as illustrated in FIG. 4A herein above. The framing member 240 further includes a series of oblong openings 248 spaced at substantially uniform intervals there along. These openings enable the formation of wiring trace passages around an assembled corner structure as illustrated in FIG. 4A.

Figure 5:
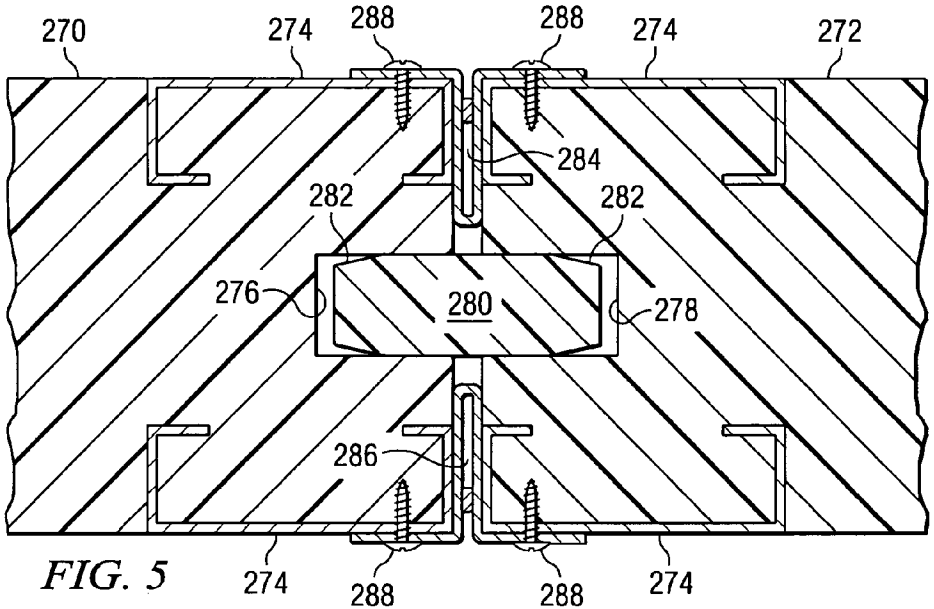
FIG. 5 illustrates a cross section detail of the joining of two insulated structural building panels according to the present disclosure.

Referring to FIG. 5, there is illustrated an exploded cross section detail of the joining of two insulated structural building panels according to the present disclosure without the use of caulking material or attachment plates or other hardware. A first ISB panel 270 and a second ISB panel 272, which are to be brought together at their edges are shown. Each first 270 and second 272 ISB panel includes a pair of framing members 274 at the respective edges of the ISB panels to be joined together. Each first 270 and second 272 ISB panel further includes a respective mortise 276 and 278 disposed between the pair of framing members 274 at the respective edges of the ISB panels that are joined together. A key 280 is shown in cross section between the mortises 276 and 278 of the first 270 and second 272 ISB panels and along an imaginary centerline passing through a centerline of the respective first 270 and second 272 ISB panels. As the edges of the first 270 and second 272 ISB panels are brought together, each tapered edge 282 of the key 280 is caused to enter the adjacent mortise 276 and 278. When the joint is fully achieved, the edges of the first 270 and second 272 ISB panels are in contact and the key is fully received within the mortises to secure the joint and to align the ISB panels together.

Also shown in FIG. 5 are T members 284, 286, shown in cross section and inserted in and along the joint formed by the ISB panels 270, 272 and the key 280. The T members 284, 286 are auxiliary framing members (described in detail in FIG. 8A infra) that can be used to provide added loading capacity where needed. The T members may be secured with the screws 288 as shown. The screws 288 may be the #8×½" Tech screws as mentioned herein above. It will be appreciated, however, that the joint may be achieved without the use of other components, fasteners, adhesives or caulking material. The key may be fabricated of rigid foam, such as the expanded polyethylene (ESP) used in the ISB panels. However, the density of the rigid foam used in the key may typically be somewhat higher at approximately 1.5 pounds per cubic foot or more.

Figure 6:
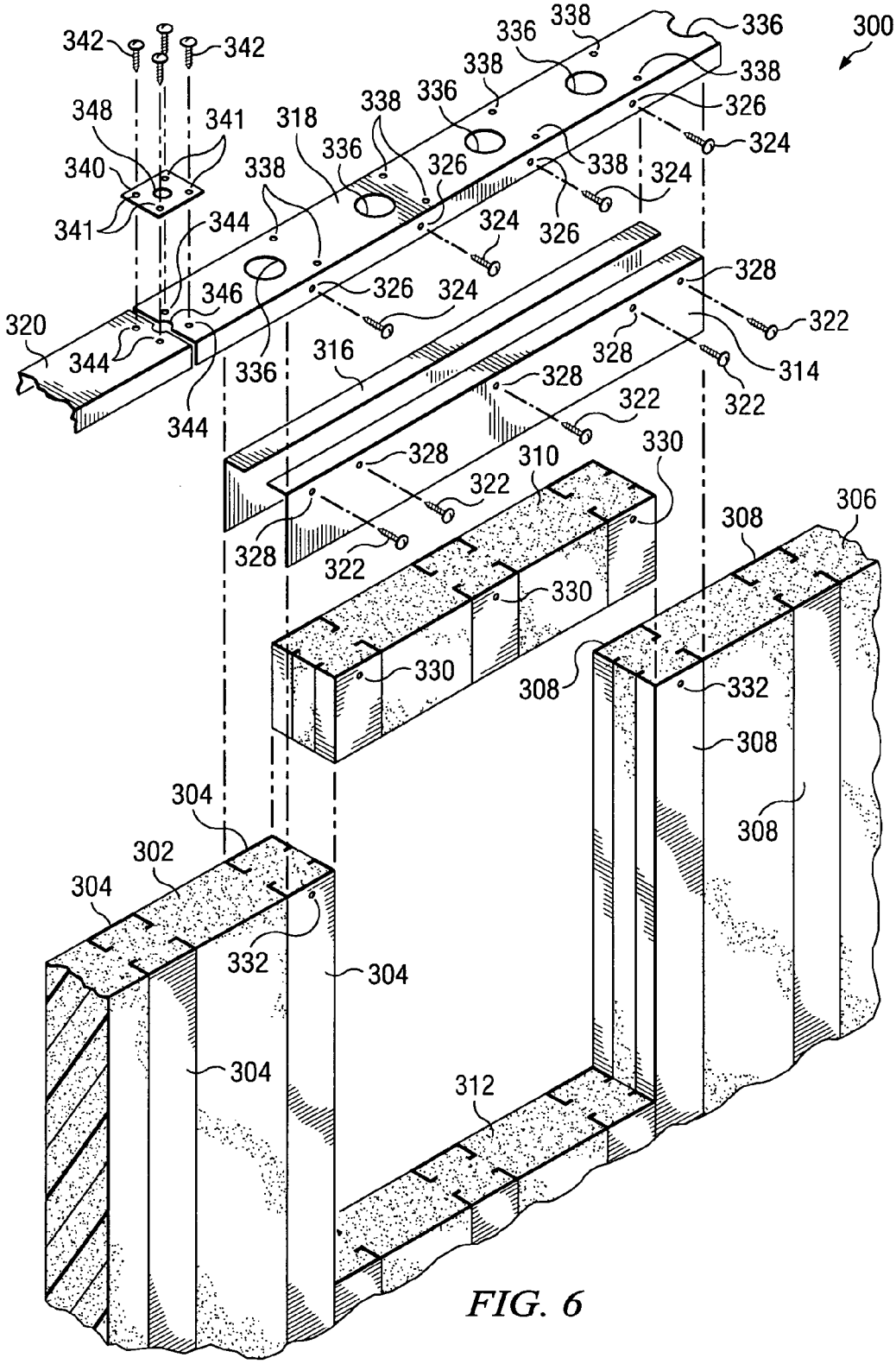
FIG. 6 illustrates an exploded perspective view of the assembly of components of the insulated structural building panel system according to the present disclosure.

Referring to FIG. 6, there is illustrated an exploded perspective view of components of the insulated structural building ("ISB") panel system according to the present disclosure. The figure illustrates the upper portion of the section of an exterior wall 300 that includes the window opening as shown. The dashed lines indicate the alignment of the various components as they are brought together during assembly. An upper in-fill cap 310 cut from a section of an ISB panel according to the present disclosure is used to fill the upper space in the wall, between the ISB wall panels 302, 306 to either side of the window opening in the wall 300 and above the window opening. In the FIG. 6, the ISB panels 302, 306, in-fill cap 310, and in-fill panel 312 as shown are simplified ISB panels (of the type illustrated in FIG. 2A) having a uniform thickness and no mortises, in order to clarify the functions bing illustrated. In practice, the ISB panels 302, 306 may preferably be either the standard ISB panel of FIG. 3A or the DWC ISB panel of FIG. 3B, with full functionality as illustrated. Similarly, the in-fill cap 310 and in-fill panel 312 may preferably be cut from the DWC ISB panel of FIG. 3B. First and second L-shaped headers 314, 316, typically fabricated of 18 gauge galvanized sheet steel, are positioned across and on either side of the top of the in-fill cap 310 and the adjoining wall panels 302, 306. The first and second L-shaped headers 314, 316 are secured to the in-fill cap 310 and the adjoining wall panels with screw fasteners 322 inserted through the holes 328 in the first L header 314 and into the holes 330 in the framing members of the in-fill cap 310 and the holes 332 in the framing members 304, 308 of the ISB panels 302, 306 respectively.

In practice, the screws 322 for securing the L headers may preferably be No. 8×½ in. Tech or self-drilling or sheet metal screws, whereby the holes in the framing members are formed by driving the screw through the holes 328 in the L header 314 into the metal of the framing members. The same technique is used to secure the second L header 316 to the interior side of the wall 300, although the fasteners and corresponding holes are not shown to preserve clarity in the illustration. Installed all along the top of the wall, over the first and second L-shaped headers 314, 316, in-fill cap 310, and the ISB wall panels 302, 306, previously assembled and secured into place, is a top plate 318—an inverted channel section also called a panel track—formed of 18 gauge galvanized sheet steel.

The top plate or top track 318 of FIG. 6 has a channel-shaped cross section and a series of uniformly spaced holes 336 approximately 2.00 inches in diameter disposed at uniform intervals along the longitudinal axis of the top track 318. These 2" diameter holes 336 are spaced to align with corresponding wire or utility chases that may be molded into the foam material of the ISB panels according to the present disclosure. The top track 318 further includes smaller holes 338 disposed at equal intervals along the edges of the top track 318 to accommodate fasteners for securing the top track to the wall panels, in-fill caps (such as in-fill cap 310) and the first and second L-shaped headers 314, 316. There may also be uniformly-spaced holes 326 disposed along the side extensions of the top track 318 to provide for driving screw or other fasteners 324 into the first and second L headers 314, 316.

Continuing with FIG. 6, an attachment plate 340 is used to bridge a joint between the top tracks 318, 320. The screws 342 are inserted through the holes 341 in the attachment plate 340 and secured in the holes 344 provided in top tracks 318, 320. The top tracks 318, 320 may also be used, inverted, as bottom plates or bottom tracks to secure the bottom ends of the ISB panels to a foundation or a second or third floor. A semicircular relief 346 may be formed in the ends of the tracks 318, 320. When used as bottom tracks, the ends of the tracks 318, 320 are butted together and an assembly is formed of an attachment plate 340 having a hole 348 in its center to accommodate a wedge bolt (not shown) through the attachment plate 340 and the semicircular relief openings 346 in the adjoining ends of the bottom tracks to secure the tracks to a foundation, for example. The top or bottom tracks may be formed in standard lengths and readily cut to size on-site during the construction of a building.

Figure 7:
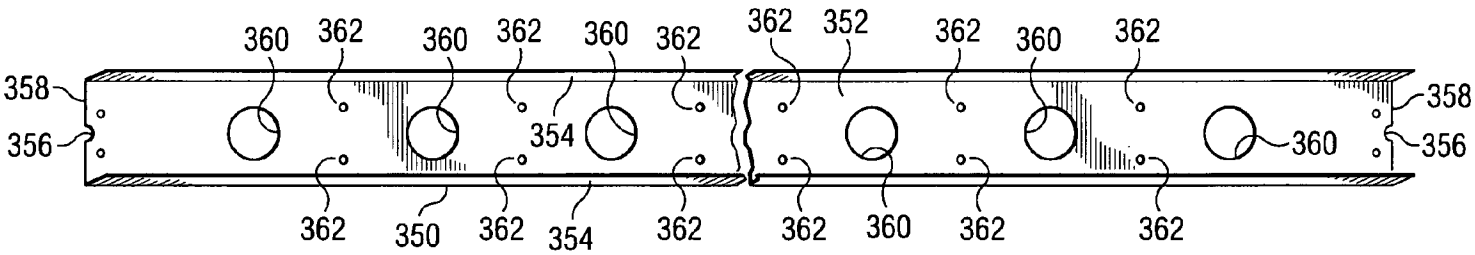
FIG. 7 illustrates one embodiment of a top and bottom track for use with the insulated structural building panels of the present disclosure.

Referring to FIG. 7, there is illustrated one embodiment of a panel track 350 for use as a top or bottom track with the insulated structural building panels of the present disclosure. An example of the use of the panel track component as a top track 318, 320 is described in FIG. 6 herein above. Although shown in a plan view, the panel track 350 (hereinafter, track 350) is configured as a channel section having a web portion 352 (i.e., the wider, center portion) approximately the same width as the thickness of an ISB panel it will be used with, and relatively short legs 354 of approximately one inch length. The panel track 350 is preferably formed, by processes well known in the art, of 18 gauge sheet metal finished with a corrosion-resistant coating 18 gauge galvanized steel is a suitable preferred material.

The panel track 350 includes a semicircular relief 356 at each end 358 for inserting wedge bolt and attachment plate assembly (as described in conjunction with FIG. 6) when connecting panel tracks 350 in serial fashion, end-to-end. Thus, the two lengths of panel track 350 are secured together in full alignment with each other.

The panel track 350 further includes several series of holes in the web portion of the panel track. A first series of holes 360, approximately 2.00 inches in diameter are disposed at equal intervals along a longitudinal centerline of the length of the panel track 350. The holes may be spaced, e.g., at six inch intervals and positioned to provide access to wire and/or plumbing traces in the ISB panels as previously described in FIGS. 3A, 3B, and 3C. A second series of holes 362, approximately 0.250 inch in diameter are disposed along second and third longitudinal center lines parallel to and spaced approximately one inch on either side of the centerline for the first series of holes. The second and third series of holes 362 are provided for inserting mounting screws (not shown) for attachment of the panel track 350 to a building foundation or slab.

Figure 8B:
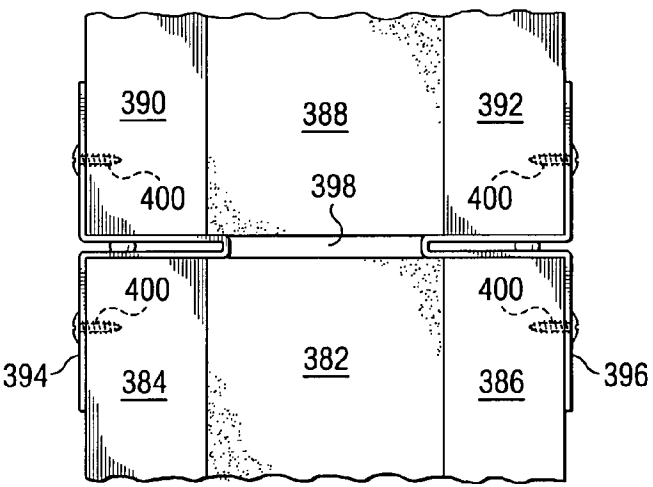
FIG. 8B illustrates one use of a T member for securing together two vertically stacked insulated structural building panels of the present disclosure.
Figure 8A:
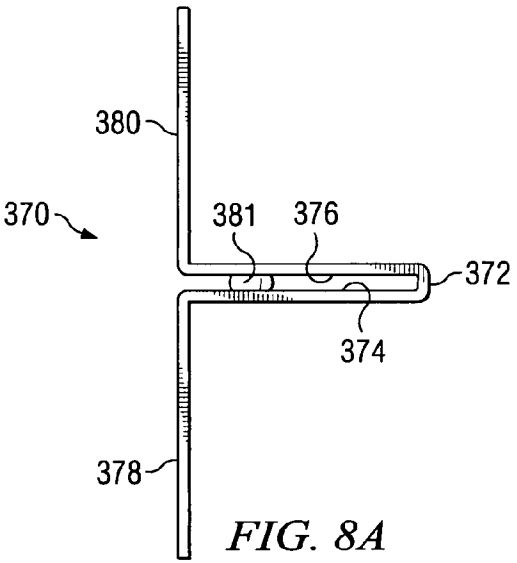
FIG. 8A illustrates one embodiment of a T member for use with the insulated structural building panels of the present disclosure.
Figure 8C:
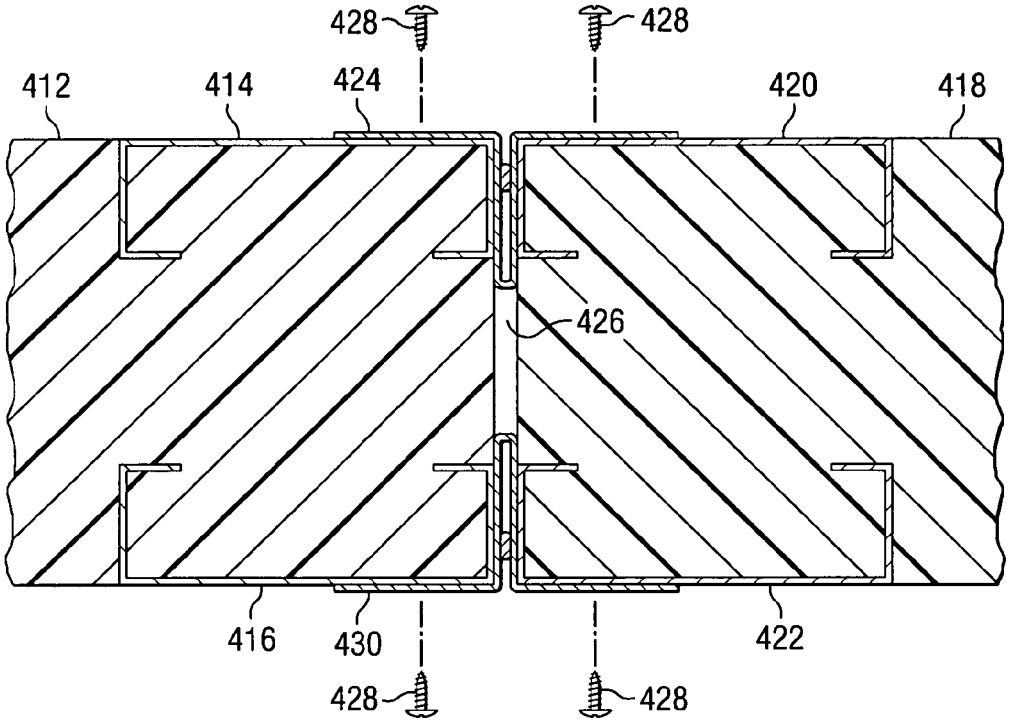
FIG. 8C illustrates another use of a T member for securing together two horizontally adjacent insulated structural building panels of the present disclosure in a configuration that also provides additional vertical loading capacity.
Figure 8D:
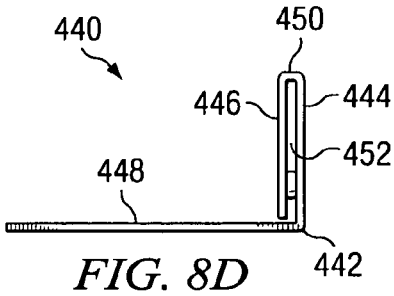
FIG. 8D illustrates one embodiment of an L member for use with the insulated structural building panels of the present disclosure.
Figure 8E:
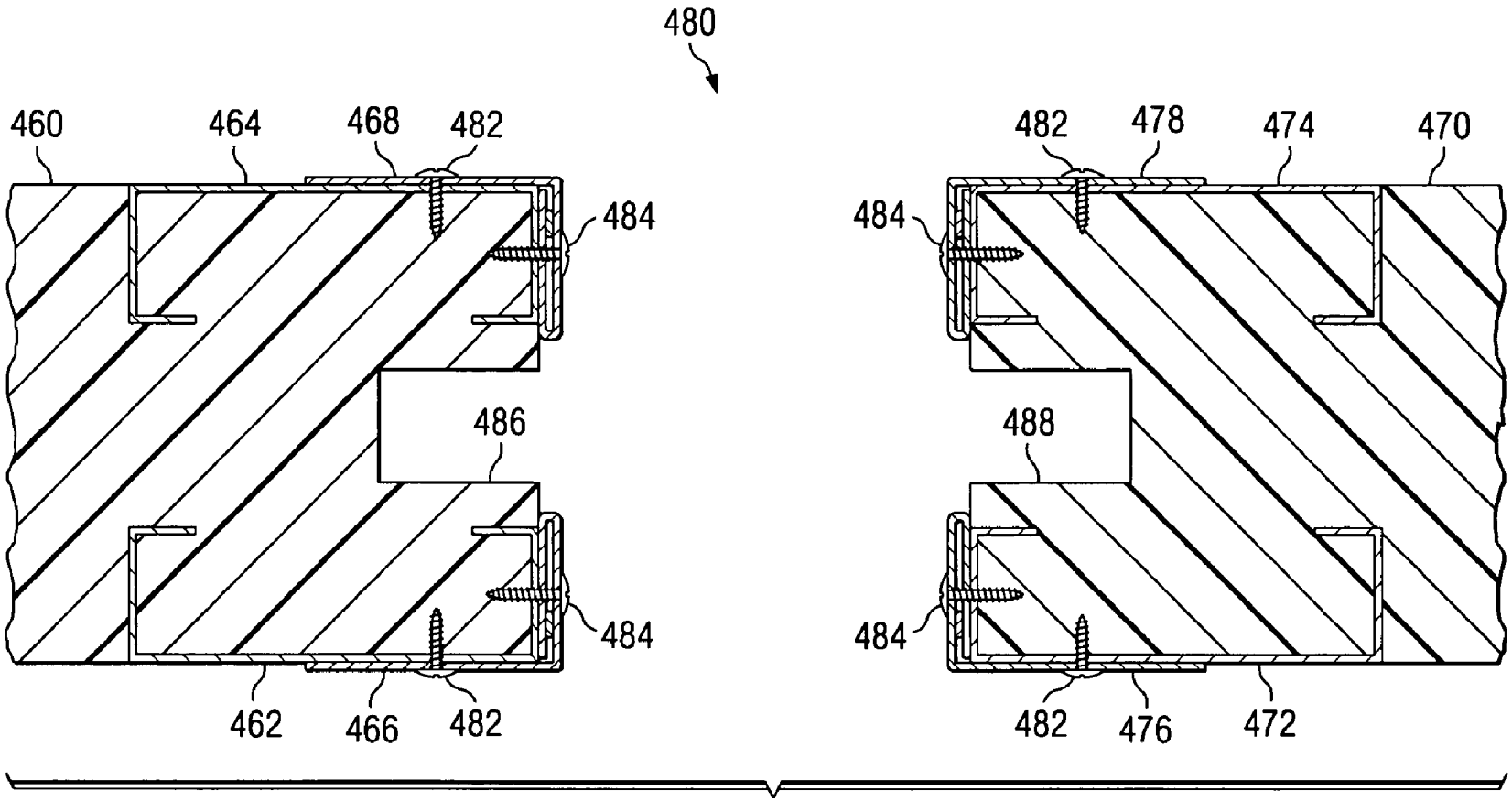
FIG. 8E illustrates one use of an L member for reinforcing the insulated structural building panels adjacent a rough opening in a configuration that may also provide additional vertical loading capacity.
Figure 9:
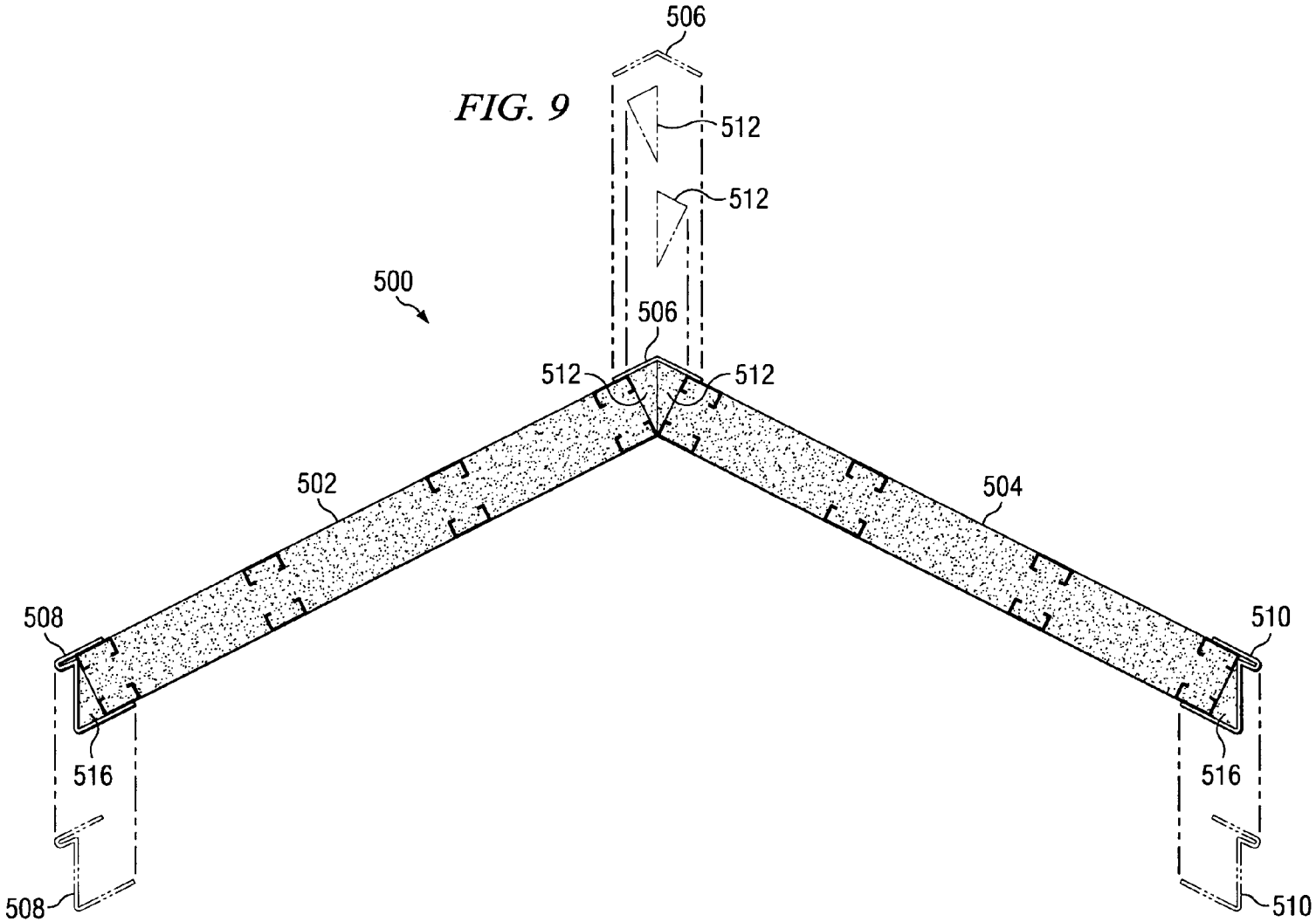
FIG. 9 illustrates a cross section of a typical roof structure formed with insulated structural building panels according to the present disclosure and first embodiments of a ridge fascia, an eave fascia, and filler strips.

Referring to FIGS. 8 and 9, there are illustrated several sheet metal components for use with the ISB panels disclosed herein for several purposes. These purposes include: to attach the ISB panels together, to provide increased strength and loading capacity, to bridge or conceal gaps in joints between ISB panels, and to provide a drip moulding along the edge of a roof structure. The components illustrated are formed of rigid sheet material such as metal, plastic, fiber reinforced synthetic or composite materials. One preferable material is sheet metal, such as galvanized steel or a metal otherwise coated with a corrosion resistant material, may be simply formed from narrow blanks of the sheet metal. The metal gauge selected depends upon the expected loads as will be well understood by persons skilled in the building design and construction arts. Alternatively, other metal alloys or materials that are currently available or become available and having suitable corrosion resistant coatings may also be used. However, in typical applications, as disclosed and illustrated herein, 20 gauge sheet steel having a galvanized finish is well suited for the purpose. The examples provided are illustrative and do not define all of the many possible accessory components that may be fabricated to facilitate the construction of buildings using the ISB panels disclosed herein. It will be appreciated that the ISB panels and associated components disclosed herein are representative of a system that enables a wide variation in building construction projects using a minimum number of standardized ISB panels and components that are readily manufacturable by uncomplicated processes, and which may easily be adapted to particular building features by on-site modifications or very simple changes in fabrication.

FIG. 8A illustrates a cross section of one embodiment of an elongated T member 370, an auxiliary framing member for use with the ISB panels of the present disclosure. The T member may variously be called a T metal, a T metal strut, or a T metal strip. A T member 370 is formed by bending the metal blank along three parallel center lines, a first center line 372 defining the longitudinal center of the blank, and second and third center lines, one on either side of and equidistant from the first center line 372. The bend along the first center line 372 is approximately 180 degrees, with a very small radius such that the adjacent faces 374, 376 of the blank are substantially in contact with each other. The bends along the second and third center lines are 90 degrees outward from each other, also with a very small radius, to form first and second legs 378, 380. The first and second legs 378, 380 together form the cross bar portion of the T in the T member 370. In practice, the actual bending steps may be performed in a sequence different than described in the foregoing. Further, the adjacent faces 374, 376 may be spot welded together at a location 381. such spot welds 381 may be placed at uniform intervals along the length of the elongated T member 370.

For use with ISB panels that are, for example, 4.00 inches thick, the length of the crossbar portion of the T member 370 may preferably be 3.0 inches and the length of the web portion (the double thickness portion of the T) may be 1.5 inches long. These dimensions may be scaled for other ISB panel thicknesses or otherwise adjusted as needed in a particular application. After forming the T member 370, the two faces 374, 376 adjacent the 180 degree bend 372 are preferably spot welded together at uniform intervals 381 along the length of the T member 370, for example at intervals of 24 inches or less, as required, to provide added strength. The T member 370 may further have mounting holes (not shown) punched along each leg 378, 380 at predetermined intervals. The mounting holes are provided for attaching the T member 370 to framing members of the ISB panels during assembly.

FIG. 8B illustrates one use of a T member for securing together two vertically stacked ISB panels of the present disclosure. A first ISB panel 382 having framing members 384 and 386, and a second ISB panel 388 having framing members 390 and 392 are shown in a stacked relationship as would be utilized for a wall unit greater in height than a single ISB panel can provide. A first T member 394 and a second T member 396 are installed in the gap 398 formed between the first 382 and second 388 ISB panels when the first 394 and second 396 T members are inserted therein as shown. The T members 394, 396 may be fabricated as described for FIG. 8A supra. The T members 394, 396 are secured to the framing members 384, 390 and 386, 392 with sheet metal screws 400, such as #8×½ in. Tech screws. It will be appreciated that the web portion of the T members 394, 396 selected should have a length less than half the thickness of the ISB panels 382, 388 to preserve the thermal break of the ISB panels 382, 388 at the joint.

FIG. 8C illustrates another use of a T member for securing together two horizontally adjacent insulated structural building panels of the present disclosure in a configuration that also provides additional vertical loading capacity. The dimensions and installation of the T members is very similar to the example described for FIG. 8B. A first ISB panel 412 having framing members 414 and 416, and a second ISB panel 418 having framing members 420 and 422 are shown in an abutting relationship as would be utilized for a wall unit greater in width than a single ISB panel can provide. A first T member 424 and a second T member 430 are installed in the gap 426 formed between the first 412 and second 418 ISB panels when the first 424 and second 430 T members are inserted therein as shown. The T members 424, 430 may be fabricated of 20 gauge galvanized sheet steel as described herein above or of suitable alternate dimensions or materials. The T members 424, 430 are secured to the framing members 414, 420 and 416, 422 with sheet metal screws 428, such as #8×½ in. Tech screws. It will be appreciated that the web portion of the T members 424, 430 selected should have a length less than half the thickness of the ISB panels 412, 418 to preserve the thermal break of the ISB panels 412, 418 at the joint between them.

FIG. 8D illustrates a cross section of one embodiment of an elongated L member, an auxiliary framing member having a doubled short leg 450 for use with the ISB panels of the present disclosure. The L member may variously be called an L metal, an L metal strut, or an L metal strip. This application is particularly well suited for increasing the allowable vertical load capacity of a wall system constructed with the ISB panels of the present disclosure. An L member 440 is formed by bending the elongated metal blank along two parallel center lines. A first center line 442 defines the blank for forming a doubled short leg 452 on one side of the center line 442, and defines the blank for forming the long leg 448 on the other side of the center line. A second center line 450 parallel to the first center line bisects longitudinally the blank for forming the doubled short leg 452. The blank is bent 90 degrees in a first direction along the first center line 442 to form the long leg 448 of the L member 440. A second bend of 180 degrees in the first direction (toward the long leg) and through a very small radius is made along the second center line 450, such that the first 444 and second 446 sides of the double short leg 452 are substantially in contact, as shown in the drawing. In practice, the actual bending steps may be performed in a sequence different than described in the foregoing.

For use with ISB panels that are 4.00 inches thick, the length of the long leg of the L member 440 may preferably be 2.50 inches and the length of the short leg (the double thickness portion of the L) may be 1.5 inches long. These dimensions may be scaled for other ISB panel thicknesses or otherwise adjusted as needed in a particular application. After forming the L member 440, the double thicknesses adjacent the 180 degree bend 450 are preferably spot welded (not shown) together along the length of the L member 440 at intervals of 24 inches or less, as required, to provide added strength. The L member 440 may further have mounting holes (not shown) punched along each leg 448, 450 at predetermined intervals. The mounting holes are provided for attaching the L member to framing members of the ISB panels during assembly.

FIG. 8E illustrates one use of an L member for reinforcing the ISB panels adjacent a rough opening in a configuration that may also provide additional vertical loading capacity. It will be appreciated that the procedure is very similar to that illustrated in FIG. 8C except that an L member is separately attached to an ISB panel instead of a T member being installed between two adjoining ISB panels. A first ISB panel 460 having framing members 462 and 464, and a second ISB panel 470 having framing members 472 and 474 are shown in a relationship on either side of a rough opening for a door or window in a wall system constructed of ISB panels. A first L member 466 and a second L member 468 are installed on the first ISB panel 460 on one side of the gap 480 formed between the first 460 and second 470 ISB panels. A third L member 476 and a fourth L member 478 are installed on the second ISB panel 470 on the other side of the gap 480 formed between the first 460 and second 470 ISB panels. The L members 466, 468, 476, and 478 may be fabricated of 20 gauge galvanized sheet steel as described herein above or of suitable alternate dimensions or materials. The L members 466, 468, 476, and 478 are preferably secured to the framing members 462, 464 and 472, 474 with sheet metal screws 482 and 484, such as #8×½ in. Tech screws, in the locations illustrated. It will be appreciated that the short leg portions of the L members 466, 468, 476, and 478 selected have a length less than half the thickness of the ISB panels 460, 470 to preserve the thermal break of the ISB panels 460, 470 at the point of reinforcement. Also shown in FIG. 8E are mortises 486, 488 formed into the edges of the ISB panels 460, 470 respectively. I the panels 460, 470 are joined together, a key (not shown, but see, e.g., FIG. 5) may be inserted in the mortises 486, 488 to align and secure the adjoining ISB panels 460, 470.

Referring to FIG. 9, there is illustrated a cross section of a typical roof structure 500 formed with ISB panels according to the present disclosure and first embodiments of a ridge fascia 506 and an eave fascia 508, 510. Illustrated are a first 502 and a second 504 ISB panel assembled to form a roof of a building having a typical six-by-twelve pitch. The gap along the ridge of the roof is covered and secured using the ridge fascia 506. The ridge fascia 506 may be formed by bending an elongated rigid sheet material blank along a longitudinal center line to an angle that matches the angle of the first 502 and second 504 ISB roof panels with respect to each other. The roof fascia may be secured to the upward surfaces of the framing members of the adjacent edges of the first 502 and second 504 ISB roof panels by installing #8×½ in. sheet metal screws (not shown) at appropriate intervals along the length of the roof ridge, through mounting holes (not shown) provided in the ridge fascia for that purpose. It is also recommended that a suitable sealing material (not shown) be used in the joint between the ridge fascia 506 and the ISB roof panels 502, 504.

Also illustrated in FIG. 9 are eave fascia 508, 510, which, when installed along the eaves of the roof structure formed by the ISB panels, provide a cap for the edge of the ISB panel and a drip moulding along the eaves to prevent the intrusion of moisture from precipitation or condensation from entering inside the building. The eave fascia are formed of sheet metal or other rigid sheet material suited to the purpose, preferably at least 24 gauge and provided with a corrosion resistant coating. The techniques of forming the material selected to the cross section shown in the illustrations of the eave fascia 508, 510 are well known in the art and will not be further described herein. The eave fascia 508, 510 may be attached to the edges of the ISB roof panels using the aforementioned sheet metal screws or suitable adhesives, along with sealing materials (not shown). In an alternate embodiment, filler strips 512 fabricated of EPS foam having the cross section shown may be fitted in the spaces between the edges of the adjoining ISB roof panels, underneath the ridge fascia 506, and in the spaces 516 within the eave fascia 510. These filler strips 512 are formed to the thickness of the roof panels and have a cross section that mimics and is determined by the roof pitch.

Figure 10A:
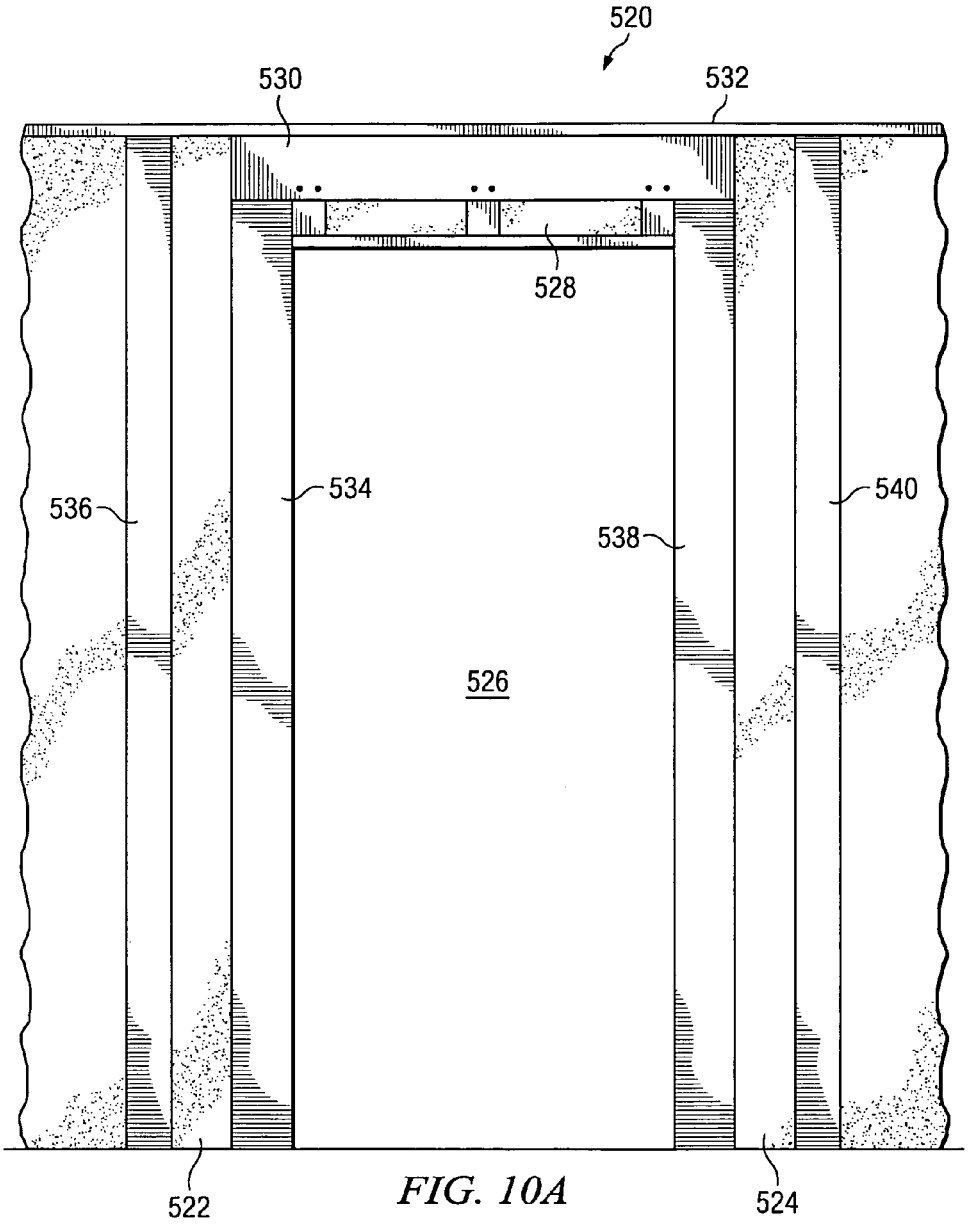
FIG. 10A illustrates one embodiment of an assembly of insulated structural building panels and header components to provide a rough opening for a door or window up to 48 inches in width.
Figure 10B:
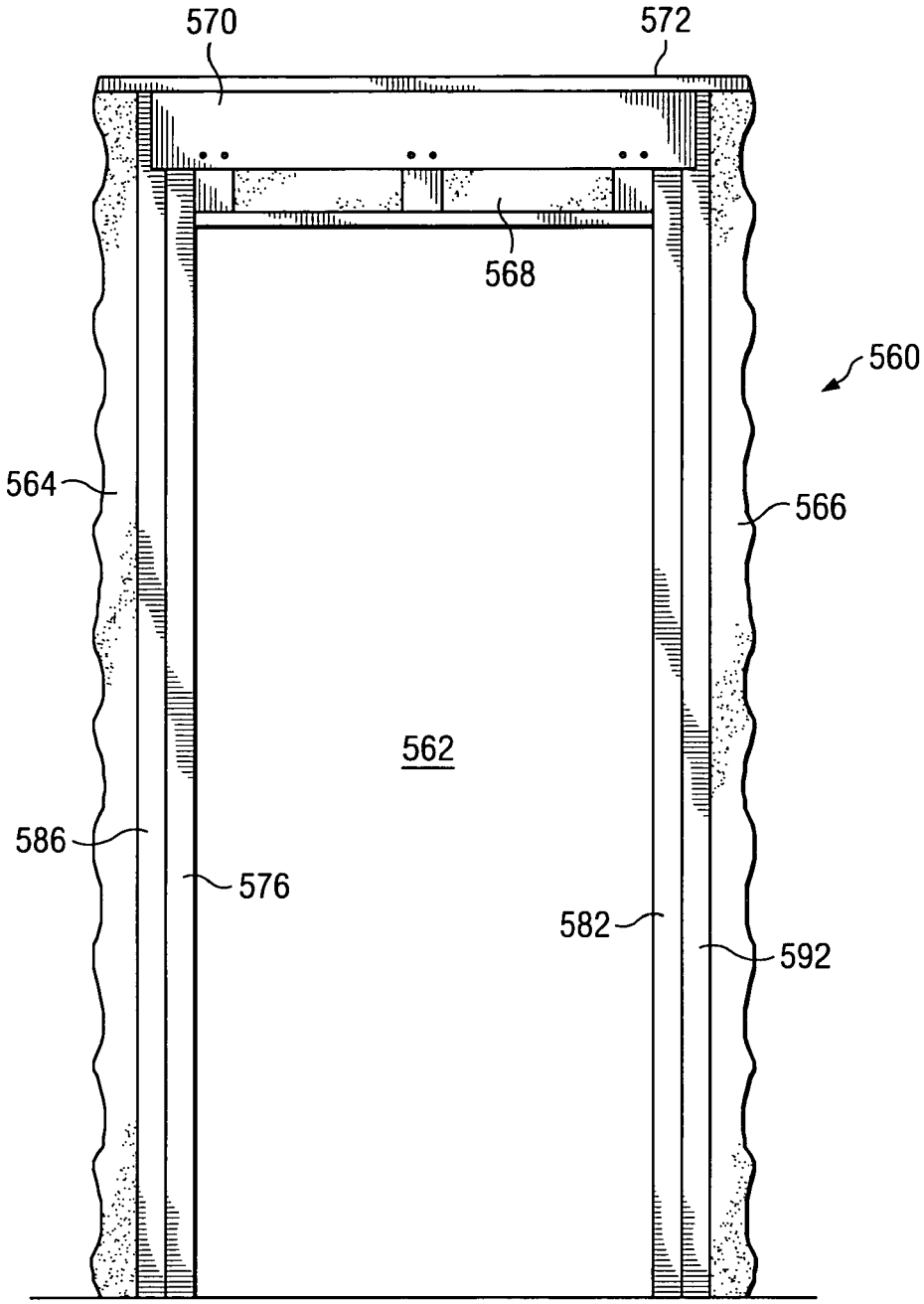
FIG. 10B illustrates another embodiment of an assembly of insulated structural building panels and header components to provide a rough opening for a door or window up to and greater than 48 inches in width.

Referring to FIGS. 10A and 10B, there are illustrated structural features of a wall system formed of ISB panels having a door, window, or other rough opening. In such applications it is important to provide sufficient load bearing capacity across the rough opening along the wall system and to minimize the amount of labor needed to provide the structural features. FIG. 10A illustrates one embodiment of an assembly of ISB panels and header components to provide a rough opening for a door or window up to 48 inches in width. A wall system 520 assembled from first 522 and second 524 ISB panels on either side of a rough opening 526 is shown. An in-fill panel 528 is installed in the upper portion of the rough opening, supported by an L header 530. The in-fill panel 528 and the L header 530 are assembled as described in FIG. 6 herein above. Although only the L header 530 on the facing side of the wall system 520 is shown, it will be understood that a like L header is installed on the back or opposite side of the wall system 520. Across the top of the wall system 520 is installed a top track 532 of the type illustrated in FIG. 7 herein above.

The components of the wall system 520 are assembled and secured using the sheet metal screws and techniques previously described. The first and second ISB panels 522, 524 may be of the type illustrated in FIG. 3B having the wider framing members 534, 538 along the edge of the respective ISB panel that forms a side of the rough opening 526. The wider framing members 534, 538 provide increased load bearing capacity on either side of the rough opening 526 than would otherwise be provided by an ISB panel if a rough opening was not present there. Also shown are adjacent framing members 536, 540 of the first 522 and second 524 ISB panels in the wall system 520.

Referring to FIG. 10B, there is illustrated another embodiment of an assembly of ISB panels and header components to provide wall system 560 having a rough opening 562 for a door or window up to and greater than 48 inches in width. This example is similar to the example of FIG. 10A except the edges of the first 564 and second 566 ISB panels on either side of the rough opening 562 are reinforced with L members as described and illustrated in FIG. 8D herein above. The assembly detail will be described in the description for FIG. 10C. As in the previous example of FIG. 10A, the upper portion of the rough opening is filled by an in-fill panel 568, supported by a first L header 570 and a second L header (not shown). The wall system 560 is further strengthened by the top track 572. The components of the wall system 560 are assembled and secured using the sheet metal screws and techniques previously described.

Figure 10C:
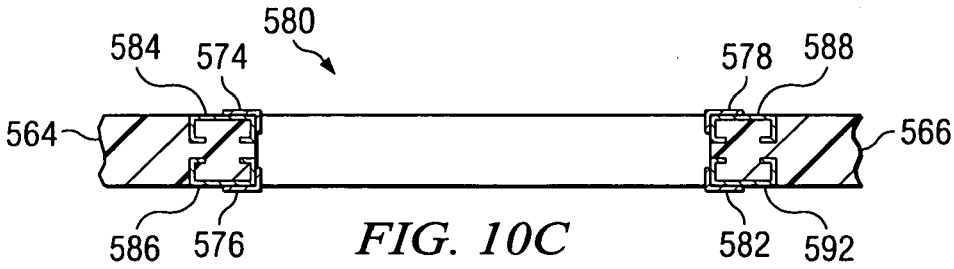
FIG. 10C illustrates a cross section detail view of the wall system of FIG. 10B.

Referring to FIG. 10C, there is illustrated a cross section detail view 580 of the wall system 560 having the rough opening 562 of FIG. 10B. Reinforcing the ISB panels 564 and 566 are respective pairs of L members 574 and 576 for the first ISB panel 564 and 578 and 582 for the second ISB panel 566. These additional components of the wall system 560 are assembled and secured using the sheet metal screws and techniques previously described.

Figure 11B:
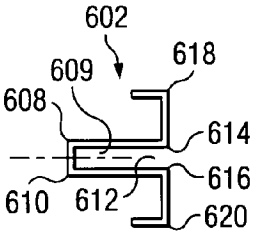
FIG. 11B illustrates a cross section view of an upper chord of a floor truss for use in one embodiment of an insulated truss panel according to the present disclosure.
Figure 11D:
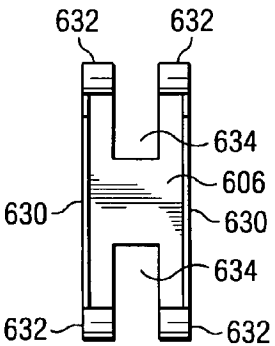
FIG. 11D illustrates a cross section view of a truss web of a floor truss for use in one embodiment of an insulated truss panel according to the present disclosure.
Figure 11F:
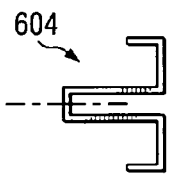
FIG. 11F illustrates a cross section view of a lower chord of a floor truss for use in one embodiment of an insulated truss panel according to the present disclosure.
Figure 11A:
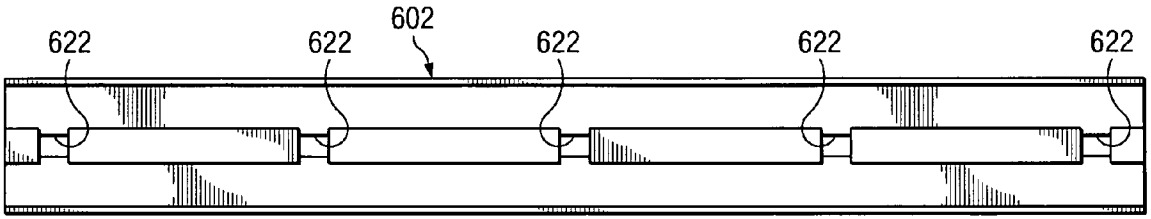
FIG. 11A illustrates a plan view of an upper chord of a floor truss for use in one embodiment of an insulated truss panel according to the present disclosure.
Figure 11C:
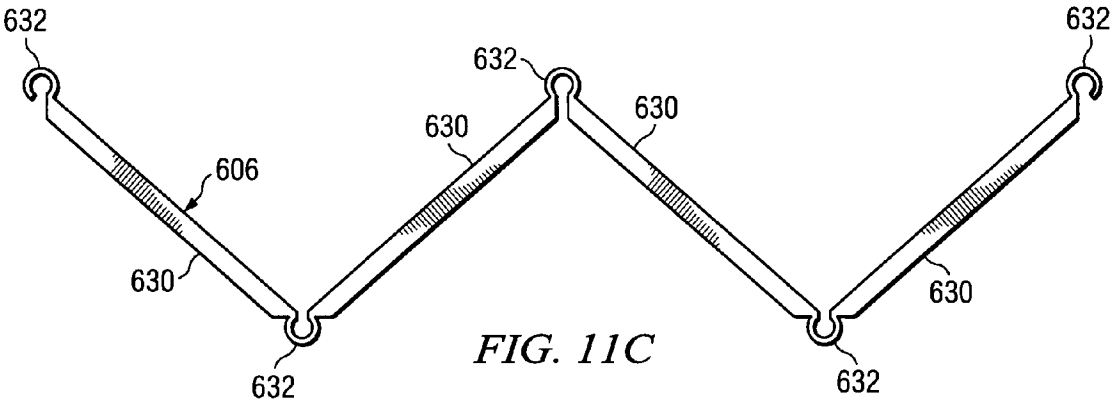
FIG. 11C illustrates a plan view of a truss web of a floor truss for use in one embodiment of an insulated truss panel according to the present disclosure.
Figure 11E:
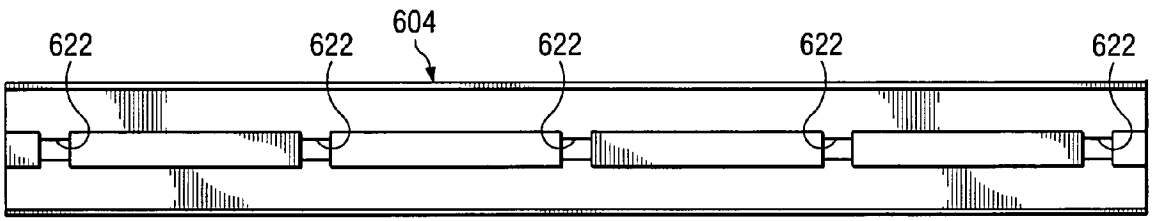
FIG. 11E illustrates a plan view of a lower chord of a floor truss for use in one embodiment of an insulated truss panel according to the present disclosure.
Figure 12A:
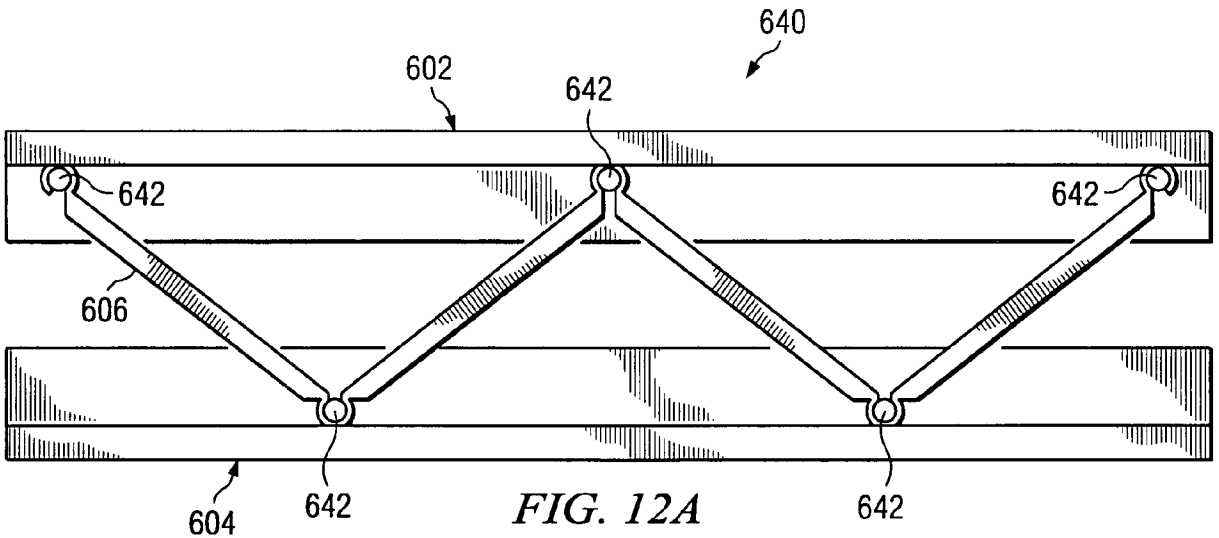
FIG. 12A illustrates a plan view of an assembled floor truss for use in fabricating one embodiment of the insulated structural truss panel according to the present disclosure.
Figure 12B:
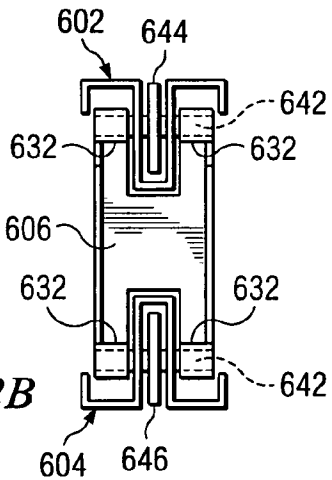
FIG. 12B illustrates an end view of an assembled floor truss for use in fabricating one embodiment of the insulated structural truss panel according to the present disclosure.

Referring to FIGS. 11A through 11F, there are illustrated plan and end views of two transverse beams or truss chords 602, 604 and a truss web 606 forming a continuous diagonal brace portion or insert used to fabricate a truss frame or floor truss 640 (See FIGS. 12A and 12B). This floor truss 640 shown in FIG. 12A is used in the improved truss panel according to the present disclosure to provide a foam/steel ISB panel capable of supporting increased loads, particularly as ceiling panels where the ceiling also functions to support the floor of the story immediately above. The two truss chords 602, 604 used in the floor truss 640 of FIG. 12A are shown in a plan view in FIGS. 11A and 11E from the perspective of the inside of the floor truss 640 and in the end views of FIGS. 11B and 11F showing the cross sections of the truss chords 602, 604. The truss chords 602, 604 may be roll formed of 20 gauge or 18 gauge spooled sheet metal, the thickness depending on the particular application and loading required. A typical truss chord 602, 604 is eight feet long; however, other lengths are possible. Moreover, the roll forming process may be configured as a continuous operation, which enables truss chords 602, 604 of any length to be fabricated. Thus, the length is limited more by the capacity of an index molding machine used to mold the completed truss panel, or by other factors in a continuous manufacturing sequence, as will be described.

Considering FIGS. 11A through 11F together, the cross sections of the truss chords 602, 604 shown in FIGS. 11B and 11F respectively (and being identical in structural features, bear the same reference numbers) resembles a "T" formed of a single width of sheet metal that may be spooled from a coil and folded through two, closely-spaced 90 degree angles 608, 610, one on either side and along a central longitudinal axis 609 of the sheet metal to form the vertical "web" of the T. Then, the sides of the single width of sheet metal are then bent approximately 90 degrees outward from the "web" of the T at 614, 616 in the figure at a predetermined distance from the first pair of 90 degree bends 608, 610 adjacent the axis to form the horizontal cross portion of the T. The outer edges of the cross portion are further bent approximately 90 degrees downward at 618, 620 to a position approximately parallel to the "web" portion of the T. An opening 622 is disposed through the "web" portion of the T, just under the cross portion of the T and at equally spaced intervals, for receiving insulated pins 642 (See FIG. 12) therethrough. The insulated pins 642, which may illustratively include a metal pin surrounded by an insulating sleeve made of a material that is substantially non-conductive to the flow of heat, such as Teflon(R), provide a bar around which are looped the apex of each bend 632 that is formed from the flat portions of the truss web 606 along the length of the truss web 606 to be further described. The insulating sleeve also provides a thermal break between the truss chords 602, 604 and the truss web 606.

Two of the truss chords 602, 604, positioned parallel to each other and with the of their "web" portions 608 pointing toward each other, are tied together with a continuous length of the truss web 606 component. The truss web 606, also roll formed from spooled sheet metal has generally a shallow channel cross section interrupted at regular intervals by a flat portion in the location where an apex 632 of the web 606 will exist when fully formed. This flat portion enables each apex 632 of the truss web 606 to wrap around all but approximately 90 to 100 degrees of each insulated pin 642 secured in the "webs" of the truss chords 602, 604 (in cross section) to form each apex 632 of the truss web 606 at each junction with a truss chord 602, 604. The flat portions of the truss web 606 correspond with the positions of the insulated pins 642 such that when assembled together, the truss web 606 forms strut members or diagonal braces that alternately and diagonally connect the two truss chords 602, 604 together to form the floor truss 640 shown in FIGS. 12A and 12B.

Referring to FIGS. 12A and 12B, there are illustrated plan and end views of an assembled truss frame or floor truss 640 for use in fabricating the insulated structural truss panel of the present disclosure. The structural features shown in FIGS. 12A and 12B are identical with the structural features shown in FIGS. 11A through 11F and therefore bear the same reference numbers. The floor truss 640 is placed into an index molding machine in each of several parallel positions in the mold cavity. The expanded polystyrene (EPS) material is forced into the mold cavity and forms an integral truss panel as the EPS material fills the mold and occupies the spaces between the various portions of the floor truss 640. As pointed out previously, the combination of the roll forming of the metal truss chords 602, 604 and the truss web 606, whose outputs are fed into position in the cavity of the index molding machine, enables the continuous fabrication process of the truss panels of the present disclosure.

Figure 13A:
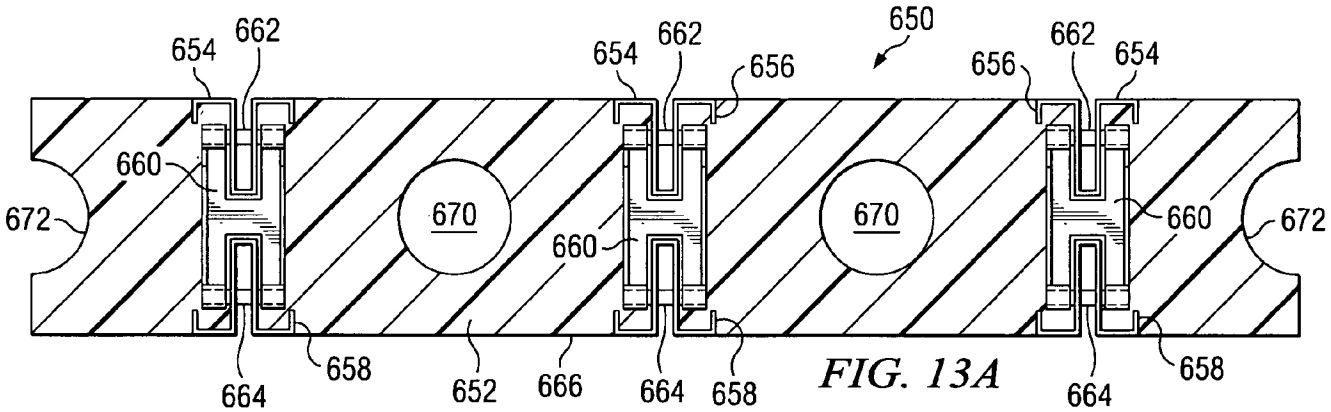
FIG. 13A illustrates one embodiment of an insulated structural truss panel according to the present disclosure.

Referring to FIG. 13A, there is illustrated an end cross section of an improved insulated structural truss panel according to the present disclosure. The illustrative truss panel may be four feet wide and 7-½ inches thick. The length, which may include spans of up to twenty feet, depends on the expected loading on the truss panel in the different applications of use, such as floors, ceiling, wall panels for supporting heavy loads, etc. The length further depends on the gauge of metal used to fabricate the truss chords and the truss webs of the truss frame or floor truss. Thus, the truss panel of the present disclosure adds to the versatility of the insulated building panel system of the present disclosure by providing panels usable in floors and ceilings as well as high-loading wall panels. As a result, a much wider variety of well-insulated building applications may be constructed easily on-site using a few standard sized insulated building panels and insulated truss panels.

Continuing with FIG. 13A, the truss panel 650 includes floor trusses 654 (three are shown on substantially equal centers) and en EPS foam panel body 652. Each floor truss 654 is an assembly of upper 656 and lower 658 truss chords joined by a truss web 660 that wraps around an upper insulated pin 662 in the upper truss chord 656 and a lower insulated pin 664 in the lower truss chord 656 at predetermined intervals along the length of the floor truss 650. The illustrative insulated structural truss panel of FIG. 13A may further include tunnels or ducts 670 having a substantially round cross-section formed within the foam insulation of the foam insulated building panel. These tunnels or ducts 670, which may be used for electricity or plumbing utility chases, for example, may be formed during molding or post-molding of the panel. When the tunnels or ducts 670 are formed in the longitudinal edge of the foam insulated building truss panel, two such panels having one-half 672 of the tunnel cross-section formed therein (that is, each half-tunnel 672 having substantially a semicircular cross-section) may be joined together such as to form together a fully circular cross-section tunnel or duct 670 along the joint. The joint between the two truss panels may further be strengthened by placing a rod (not shown) of the EPS foam formed to the length of the panels and the same substantially round diameter and cross-section as the tunnel, thereby locking the two adjoining truss panels together in the manner of a mortise and tenon joint or a keyed joint.

Figure 13B:
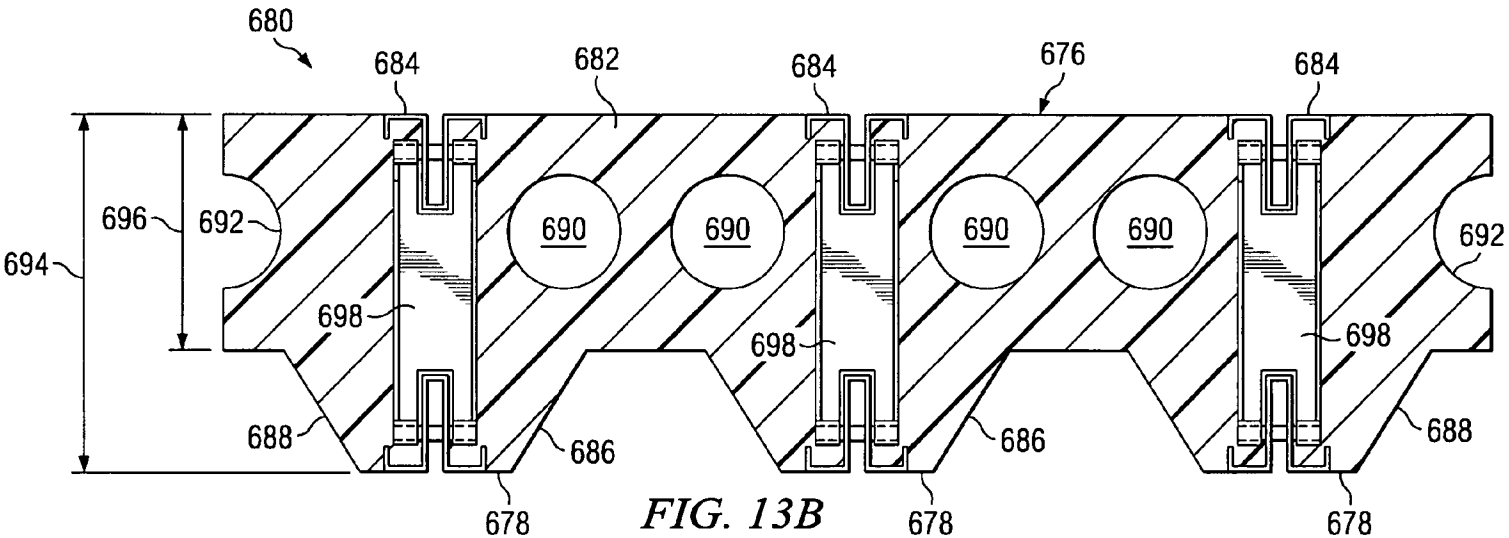
FIG. 13B illustrates an alternate embodiment of the insulated structural truss panel according to FIG. 13A of the present disclosure that is adapted for carrying heavier loads.

Referring to FIG. 13B, there is illustrated an alternate embodiment 680 of the improved insulated structural truss panel according to FIG. 13A of the present disclosure. The truss panel 680 includes floor trusses 684 (three are shown on substantially equal centers) and en EPS foam panel body 682. The panel further includes longitudinal voids or ducts 686, 688 formed in a first face 678 of the panel 680 and formed to a depth less than one-half the thickness of the panel 680 and between and parallel to the floor truss members 684. The ducts 686, 688 may have a trapezoidal cross section as shown or other cross sections such as a semicircle or its equivalent. The truss panel 680 of FIG. 13B is designed to carry heavier loads and has floor truss members of increased depth, which may have increased EPS foam thickness in the region of the floor truss members. The longitudinal ducts represent regions of the truss panel where the additional foam material provides little or no additional load-bearing or insulating value, and thus represents a savings of material. However, the longitudinal ducts may further provide spaces for installing utility conduit. For example, when used as ceiling or roof panels, electrical wiring for lighting fixtures or ceiling fans may be installed in the longitudinal ducts. The ducts with the conduit installed may then be covered with the interior or exterior wallboard used to complete a wall surface.

The illustrative insulated structural truss panel of FIG. 13B may further include tunnels or ducts 690 having a substantially round cross-section formed within the foam insulation of the foam insulated building panel. The tunnels 690, which may also be used for electricity or plumbing utility chases, for example, may be formed during molding or post-molding of the panel. When the tunnels or ducts 690 are formed in the longitudinal edge of the foam insulated building truss panel, producing a semicircular or half-round groove 692 therein, two such panels having such semicircular cross-section may be joined together to form together a fully circular cross-section tunnel 690 along the joint. The joint between the two truss panels may further be strengthened by placing a column (not shown) of the EPS foam formed to the length of the panels and the same substantially round cross-section as the tunnel, thereby locking the two adjoining truss panels together in the manner of a mortise and tenon joint or a keyed joint.

While the inventions disclosed herein have been shown illustratively in only one of their respective forms, they are not thus limited but are susceptible to various modifications without departing from the spirit thereof. For example, the return lips along the edges of the open side of the framing members that retain the framing members embedded in the rigid foam material of the panel body of an insulated structural building (ISB) panel may as readily be disposed outward or away from each other as they are disposed inward and toward each other as in the preferred embodiment. In another example, the framing members may be staggered on opposing faces of the panel body without materially affecting the utility or load bearing capacity of the ISB panels so constructed. In yet another modification, the framing members may be oriented in directions that are not parallel with the edges of the panel body or with each other. Further, framing members may be configured with a variety of holes, openings, attachments and fixtures to accommodate a variety of adjoining components, attachments, or be modified as to the dimensions or materials used in their fabrication to suit particular applications.

While the ISB panel system disclosed herein has been devised to minimize the costs of manufacturing the panels and the costs of using the ISB panels and associated components in erecting buildings, the ISB system is susceptible to embodiments fabricated for custom designed buildings to meet particular requirements while retaining the aforementioned advantages of the inventions over the prior art building panels.

What is claimed is:

1. An insulated structural truss panel, comprising:

a rectangular panel body having no outer skin, being molded of insulating foam material to form a rigid foam structure and having a defined width between first and second sides, first and second ends separated by a defined length, and first and second substantially parallel faces; and a parallel arrangement of at least first and second truss members positioned in a mold and embedded longitudinally within the panel body during molding thereof at predetermined on-center spacings between and parallel to the first and second sides wherein each truss member comprises:

first and second parallel truss chords separated by a predetermined distance;

a plurality of insulated pins spaced at predetermined intervals along each first and second truss chord and disposed at a right angle through the truss chord along an edge of the truss chord nearest a centerline disposed intermediate the upper and lower truss chords of the truss; and a one-piece truss web formed by wrapping a continuous strip of diagonal braces around each insulated pin in turn while alternating the continuous strip between the upper and lower truss chords, whereby a thermal break is provided between the truss web and each truss chord.

2. The truss panel of claim 1, wherein at least a third truss is disposed between and parallel to the first and second truss members.

3. The truss panel of claim 1, wherein each first and second truss chord is roll-formed from sheet metal into a generally T-shaped cross section wherein a cross bar portion of the T forms the outer side of the truss chord and a web portion of the T perpendicular to the cross bar of the T supports the insulated pins there through and extends inward toward the opposite truss chord when in position in the truss.

4. The truss panel of claim 1, wherein the truss web is formed of a single continuous metal strip wrapped around and secured to the insulated pins alternately between the first and second truss chords of the truss from the first end of the truss to the second, opposite end of the truss.

5. The truss panel of claim 1, wherein each insulated pin is formed of metal rod material surrounded by a sleeve of an insulating material for providing a thermal break between the truss web and a truss chord, the insulated pin being fixed at a defined point thereof in the web of the truss chord and disposed parallel to the surface coincident with the cross bar of the T of the truss chord and at right angles to a longitudinal axis of the truss chord.

6. The apparatus of claim 1, wherein the truss member is formed and assembled in a continuous process which roll forms the truss chords and the truss web, respectively feeding them into position in a fixture for alternately connecting the truss web successively to each insulated pin inserted into the web portion of the truss chord and securing the truss web to the respective insulated pins in turn.

7. The apparatus of claim 6, wherein the truss assemblies are fed, in predetermined lengths, into at least one mold cavity of a molding machine in a plurality of predetermined parallel positions in the mold cavity to be embedded in a molded body of the insulating foam in the molding machine during molding thereby assembling and forming the insulated structural truss panel.

8. The truss panel of claim 1, wherein the panel body is molded of expanded polystyrene foam having a density in the range of 0.5 to 3.0 pounds per cubic foot.

9. The truss panel of claim 1, wherein the truss member is formed of galvanized sheet metal having a minimum tensile strength of 36,000 pounds per square inch.

10. The apparatus of claim 1, further comprising:

a longitudinal recess formed into the second face of the molded body of the truss panel between and parallel to the truss members along the defined length of the truss panel.

11. The apparatus of claim 10, wherein the longitudinal recesses are formed to a depth from the second face not exceeding one-half the thickness of the insulated structural truss panel.

12. The apparatus of claim 1, wherein the insulated structural truss panel further comprises:

at least one tubular void having a substantially round cross-section that is formed within the insulated structural truss panel approximately equidistant between the first and second faces of the insulated structural truss panel, between and parallel to two of the trusses and along the defined length of the structural truss panel.

13. The apparatus of claim 12, wherein at least one-half of a tubular void having a substantially semicircular cross-section is formed within the insulated structural truss panel approximately equidistant between the first and second faces of the insulated structural truss panel along the defined length of at least one longitudinal edge of the insulated structural truss panel and parallel to an adjacent-most truss member, whereby two such truss panels may be assembled together at the edge having the semicircular tubular voids to form a double truss panel having a common tubular void to be filled by a rigid foam column having approximately the same diameter as the substantially round tubular void, thereby forming a keyed or mortise-and-tenon joint between the adjoining truss panels.

* * * * *